US011311159B2

(12) United States Patent
Lenkiewicz et al.

(10) Patent No.: US 11,311,159 B2
(45) Date of Patent: Apr. 26, 2022

(54) EXTRACTION CLEANER

(71) Applicant: BISSELL Inc., Grand Rapids, MI (US)

(72) Inventors: Kenneth M. Lenkiewicz, Grand Rapids, MI (US); Tom Minh Nguyen, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 390 days.

(21) Appl. No.: 16/453,801

(22) Filed: Jun. 26, 2019

(65) Prior Publication Data

US 2019/0313865 A1 Oct. 17, 2019

Related U.S. Application Data

(60) Continuation of application No. 15/386,964, filed on Dec. 21, 2016, now Pat. No. 10,342,402, which is a continuation of application No. 14/817,749, filed on Aug. 4, 2015, now Pat. No. 9,549,648, which is a division of application No. 13/408,684, filed on Feb. 29, 2012, now Pat. No. 9,107,558.

(60) Provisional application No. 61/447,814, filed on Mar. 1, 2011.

(51) Int. Cl.

| | |
|---|---|
| ***A47L 7/00*** | (2006.01) |
| ***A47L 11/40*** | (2006.01) |
| ***A47L 11/34*** | (2006.01) |
| ***A47L 5/22*** | (2006.01) |

(52) U.S. Cl.

CPC ..... *A47L 7/0009* (2013.01); *A47L 5/225* (2013.01); *A47L 7/0004* (2013.01); *A47L 11/34* (2013.01); *A47L 11/40* (2013.01); *A47L 11/4002* (2013.01); *A47L 11/4008* (2013.01); *A47L 11/4016* (2013.01); *A47L 11/4019* (2013.01); *A47L 11/4041* (2013.01); *A47L 11/4044* (2013.01); *A47L 11/4083* (2013.01); *A47L 11/4088* (2013.01)

(58) Field of Classification Search

CPC ..... A47L 7/0009; A47L 11/4008; A47L 11/4019; A47L 7/0004; A47L 11/4002; A47L 5/225; A47L 11/34; A47L 11/40; A47L 11/4016; A47L 11/4041; A47L 11/4044; A47L 11/4083; A47L 11/4088

See application file for complete search history.

(56) References Cited

U.S. PATENT DOCUMENTS

| | | | |
|---|---|---|---|
| 4,934,017 | A | 6/1990 | Kent |
| 5,309,600 | A | 5/1994 | Weaver et al. |
| 5,363,535 | A | 11/1994 | Rench et al. |
| 5,406,673 | A | 4/1995 | Bradd et al. |
| 5,715,566 | A | 2/1998 | Weaver et al. |
| 5,761,763 | A | 6/1998 | McAllise et al. |
| 5,896,617 | A | 4/1999 | Kasen et al. |
| 5,933,912 | A | 8/1999 | Karr et al. |

(Continued)

FOREIGN PATENT DOCUMENTS

| | | | |
|---|---|---|---|
| GB | 2334668 | A | 1/1999 |
| GB | 2407967 | A | 5/2005 |

(Continued)

*Primary Examiner* — David Redding

(74) *Attorney, Agent, or Firm* — McGarry Bair PC

(57) ABSTRACT

An extraction cleaner includes a portable extractor and a base adapted to be moved to perform a cleaning operation on a floor surface when the portable extractor is operably mounted to the base. The portable extractor includes a recovery tank assembly provided on the housing adjacent to the recovery tank assembly.

20 Claims, 17 Drawing Sheets

(56) References Cited

U.S. PATENT DOCUMENTS

| | | | |
|---|---|---|---|
| 6,094,775 | A | 8/2000 | Behmer |
| 6,131,237 | A | 10/2000 | Kasper et al. |
| 6,869,065 | B1 | 3/2005 | Lin |
| 6,961,975 | B2 | 11/2005 | Park et al. |
| 7,073,226 | B1 | 7/2006 | Lenkiewicz et al. |
| 7,360,274 | B2 | 4/2008 | Park et al. |
| 7,377,007 | B2 | 5/2008 | Best |
| 7,377,008 | B2 | 5/2008 | Park et al. |
| 7,600,291 | B2 | 10/2009 | Choi |
| 2006/0191099 | A1 | 8/2006 | Fry et al. |
| 2011/0023262 | A1 | 2/2011 | Conrad |

FOREIGN PATENT DOCUMENTS

| | | | |
|---|---|---|---|
| GB | 2424361 | A | 9/2006 |
| GB | 2445315 | A | 2/2008 |
| GB | 2458220 | A1 | 9/2009 |
| WO | 2009042663 | A1 | 4/2009 |

EXTRACTION CLEANER

CROSS REFERENCE TO RELATED APPLICATIONS

This application is a continuation of U.S. patent application Ser. No. 15/386,964, filed Dec. 21, 2016, now U.S. Pat. No. 10,342,402 issued on Jul. 9, 2019, which is a continuation of U.S. patent application Ser. No. 14/817,749, filed Aug. 4, 2015, now U.S. Pat. No. 9,549,648, which is a division of U.S. patent application Ser. No. 13/408,684, filed Feb. 29, 2012, now U.S. Pat. No. 9,107,558, issued Aug. 18, 2015, which claims the benefit of U.S. Provisional Patent Application No. 61/447,814, filed Mar. 1, 2011, all of which are incorporated herein by reference in their entirety.

BACKGROUND

Extractors are well-known devices for deep cleaning carpets and other fabric surfaces, such as upholstery. Most carpet extractors comprise a fluid delivery system and a fluid recovery system. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. The fluid recovery system usually comprises a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. The agitation system can include an agitator element for scrubbing the surface to be cleaned, an optional drive means, and selective control means. The agitation system can include a fixed or driven agitator element that can comprise a brush, pad, sponge, cloth, and the like. The agitation system can also include driving and control means including motors, turbines, belts, gears, switches, sensors, and the like. An example of an extractor is disclosed in commonly assigned U.S. Pat. No. 6,131,237 to Kasper et al., which is incorporated herein by reference in its entirety. U.S. Pat. No. 5,715,566 to Weaver discloses an extraction cleaning machine capable of being used as an upright machine, or as a separate extraction cleaning module.

BRIEF DESCRIPTION

An aspect of the present disclosure relates to an extraction cleaner, comprising a portable extractor comprising a housing having a suction source, a suction hose interconnected to the suction source for manually suctioning fluid from a floor surface a recovery tank interconnected to the suction hose for receiving recovered fluid from the floor surface, a fluid delivery system for dispensing a cleaning fluid onto the floor surface, and a base adapted to be moved to perform a cleaning operation on the floor surface when the portable extractor is operably mounted to the base, the base including a suction nozzle juxtaposed with the floor surface, and a diverter valve for selectively fluidly interconnecting the recovery tank with one of the suction hose and the suction nozzle, the diverter valve, comprising a follower provided on one of the portable extractor and the base, and a cam provided on the other of the portable extractor and the base wherein the diverter valve opens fluid communication between the recovery tank and the suction nozzle when the portable extractor is operably mounted to the base.

BRIEF DESCRIPTION OF THE DRAWINGS

The invention will now be described with respect to the drawings in which.

DETAILED DESCRIPTION

Figure 1:
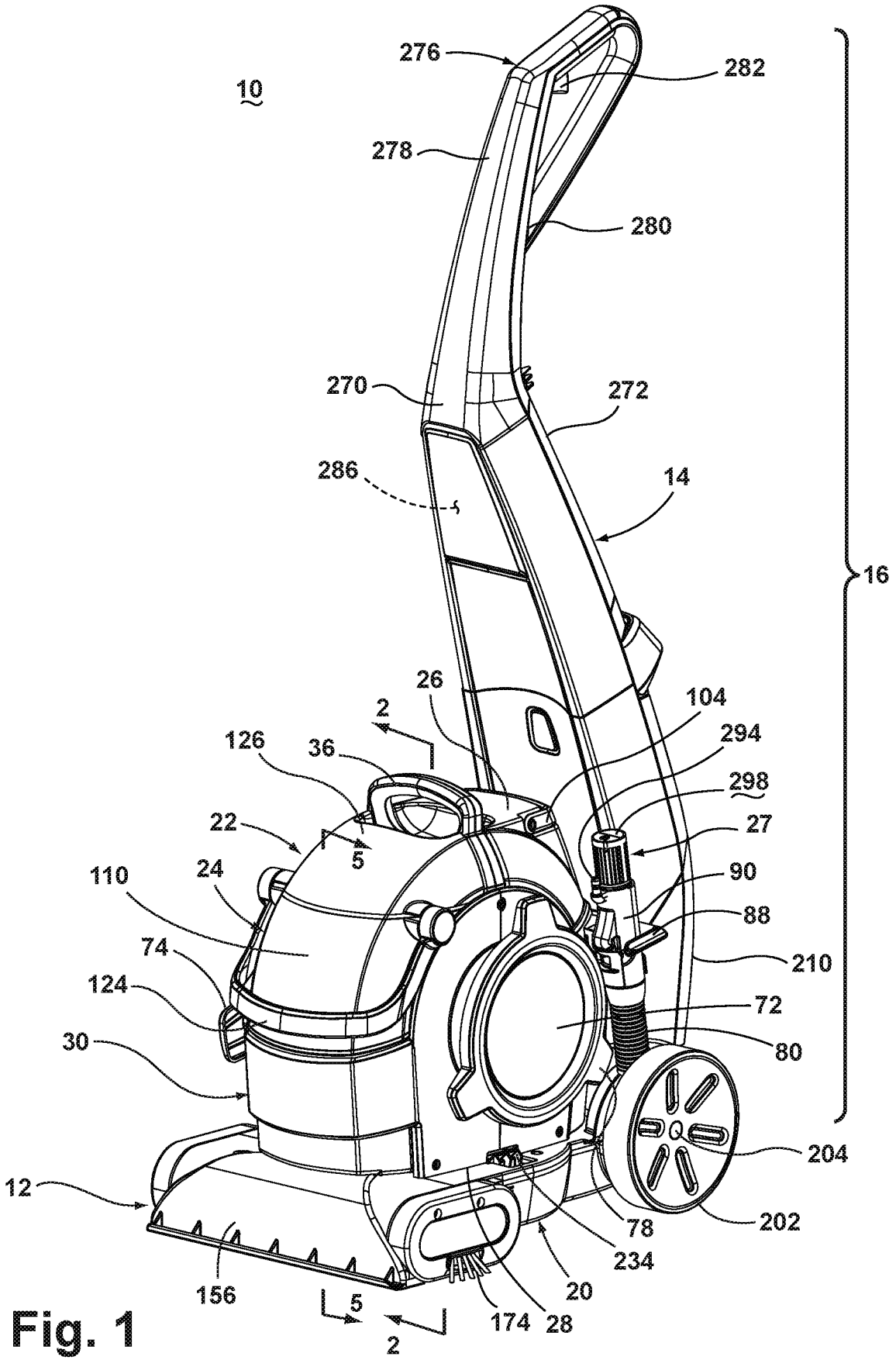
FIG. 1 is a front, right perspective view of an extractor according to the invention with a handle assembly pivotally mounted to a base assembly.
Figure 2:
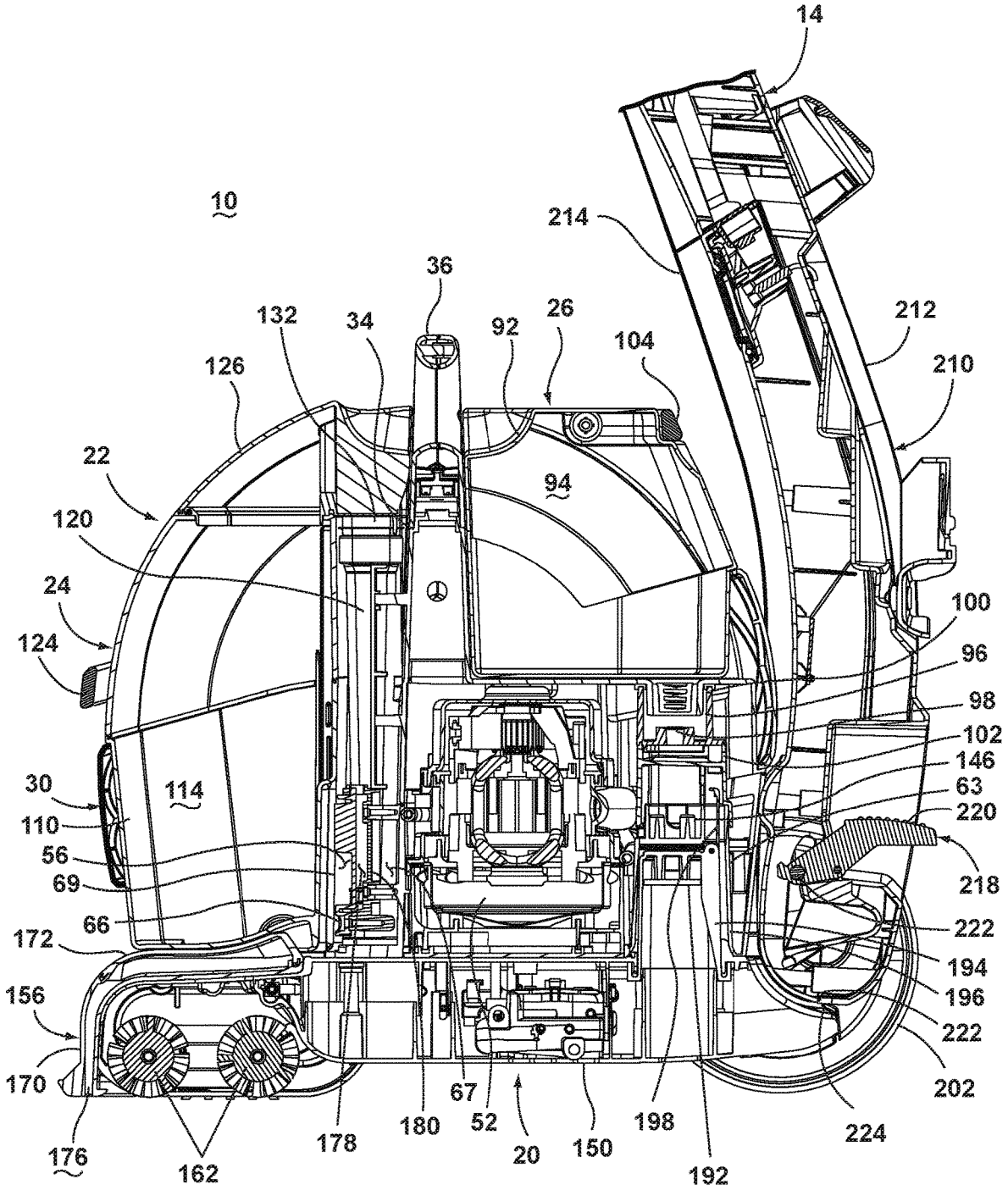
FIG. 2 is a cross-sectional view of the extractor taken along line 2-2 of FIG. 1.
Figure 3:
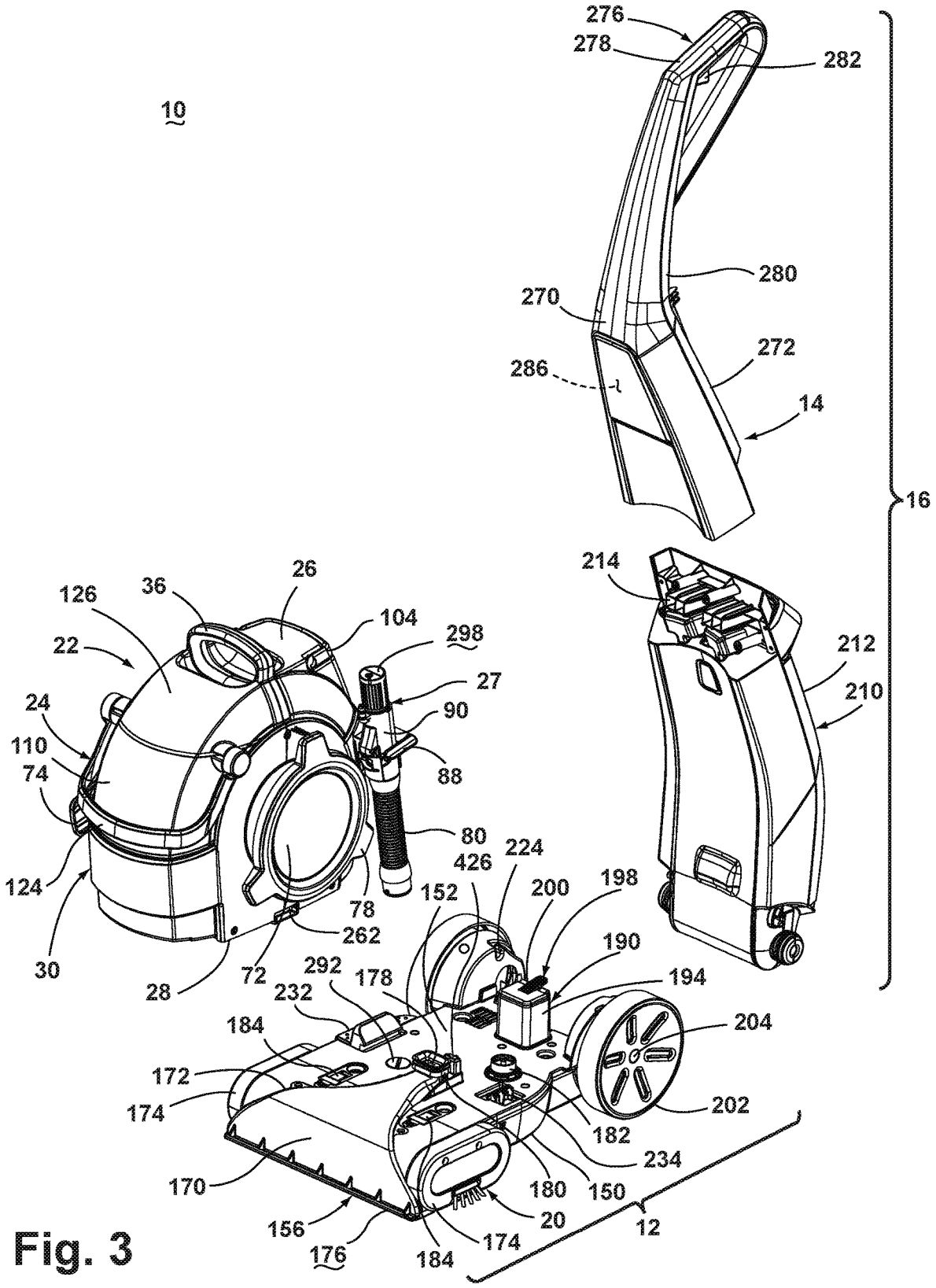
FIG. 3 is a partial exploded view of the extractor of FIG. 1, illustrating an extraction pod, a base assembly, and a handle assembly.

Referring now to the drawings and particularly to FIGS. 1-3, an upright extractor 10 according to the invention comprises a housing having a base assembly 12 for movement across a surface to be cleaned and a handle assembly 16 pivotally mounted to a rearward portion of the base assembly 12 for directing the base assembly 12 across the surface to be cleaned. The extractor 10 includes a fluid distribution system for storing cleaning fluid and delivering the cleaning fluid to the surface to be cleaned and a fluid recovery system for removing the spent cleaning fluid and dirt from the surface to be cleaned and storing the spent cleaning fluid and dirt. The components of the fluid delivery system and the fluid recovery system are supported by at least one of the base assembly 12 and the handle assembly 16.

The base assembly 12 comprises a base platform 20 that supports a selectively detachable and portable extraction pod 22 at a forward portion thereof, forward being defined as relative to the mounting location of the handle assembly 16 on the base assembly 12. The pod 22 comprises a recovery tank assembly 24, a solution supply tank assembly 26, an accessory wand 27, and an extraction module lower body 28 in which the recovery and supply tank assemblies 24, 26 are removably received. The pod 22 is illustrated as a generally arcuate member, however, other shapes are feasible.

Figure 4:
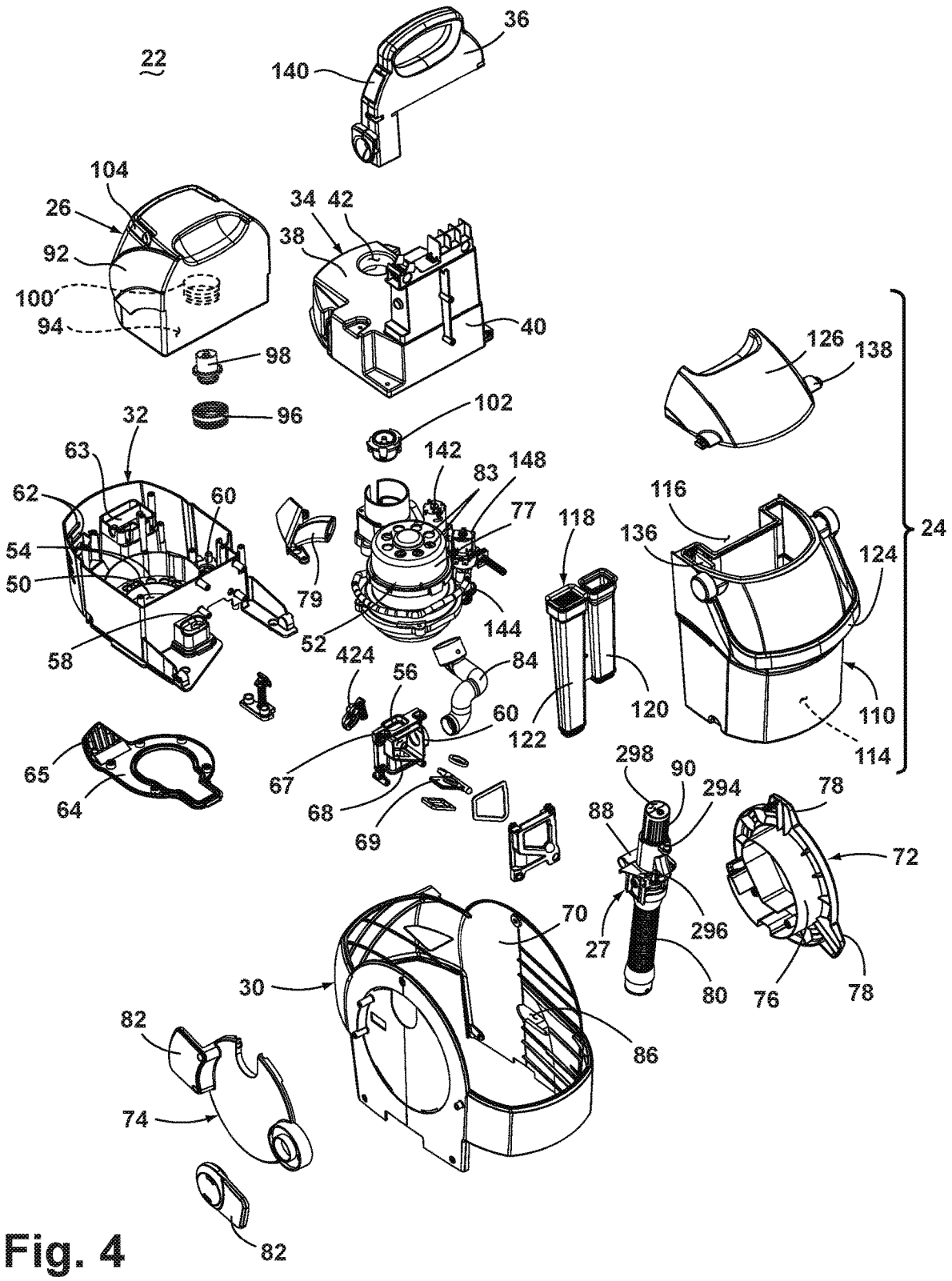
FIG. 4 is an exploded view of the extraction pod of the extractor of FIG. 1.
Figure 5:
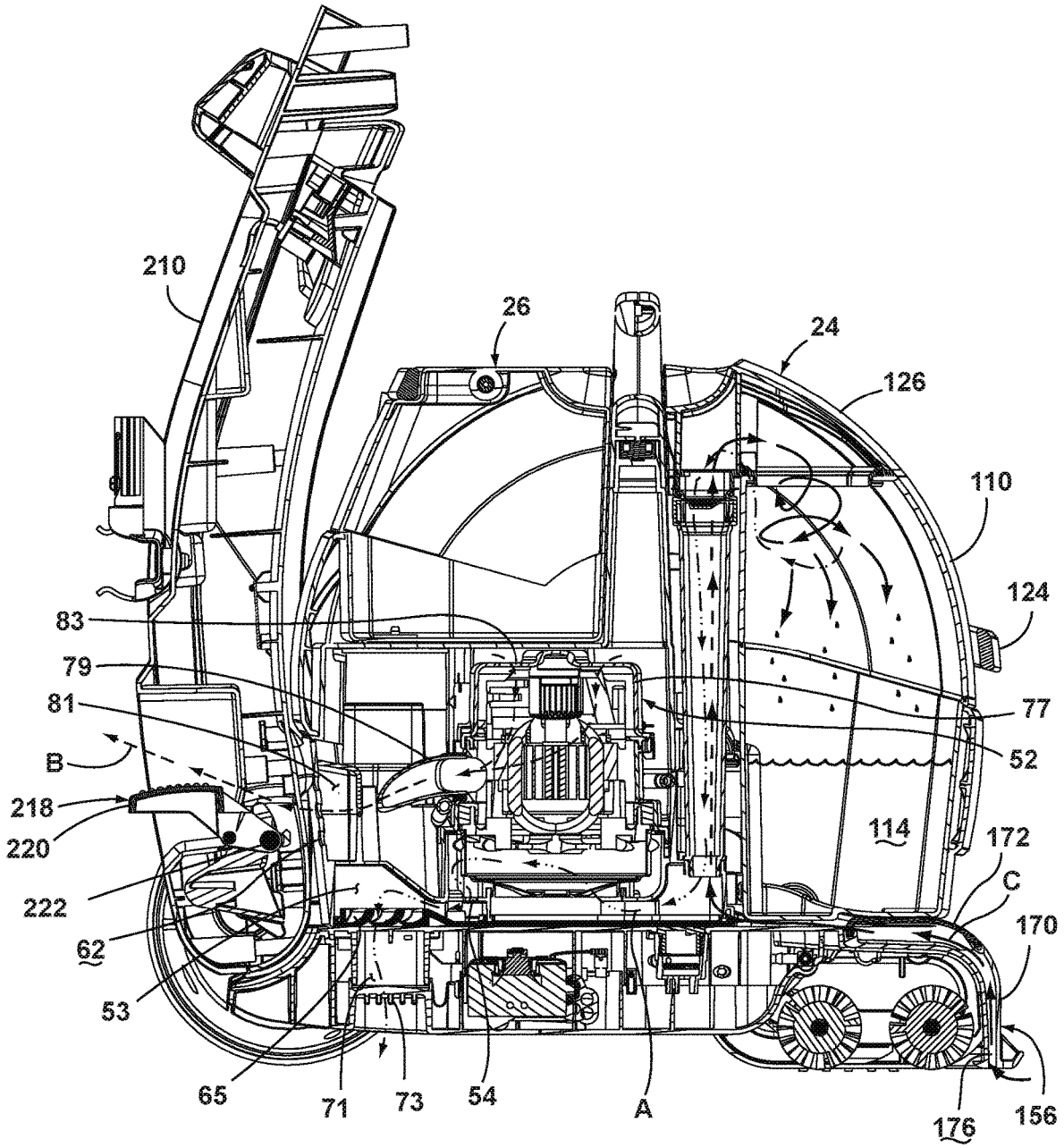
FIG. 5 is a cross-sectional view of the extractor taken along line 5-5 of FIG. 1.

Referring to FIGS. 3-5, the lower body 28 comprises a module housing 30, a base 32, a base cover 34, and a handle 36. The base 32 is a generally rectilinear body incorporating various indentations and attachment features such as bosses, ribs, and the like for attaching the components that are mounted to the base 32. The base 32 comprises a motor cavity 50 in which a motor/blower assembly 52 is mounted for generating a working air flow through the fluid recovery system. A plurality of exhaust holes 54 are formed through the bottom of the motor cavity 50. A working air exhaust chamber 53 adjacent to the lower portion of the motor cavity 50 is fluidly connected to the exhaust holes 54. An air path cover 64 is mounted beneath the base 32, below the motor cavity 50 and forms a working air exhaust pathway A that fluidly connects the exhaust holes 54 with an exhaust connection illustrated herein as a plurality of working air exhaust vents 65 that are formed in a recessed portion of the cover 64, so that working air can be exhausted from the motor cavity 50 through the bottom of the pod 22. The working air exhaust vents 65 fluidly communicate with an exhaust connection illustrated herein as a plurality of exhaust inlet slots 75 in a cover plate 152 (FIG. 9) of the base assembly 12 above a corresponding exhaust channel 71 and base exhaust vents 73 in a base housing 150 of the base assembly 12, when the pod 22 is mounted on the base assembly 12. Accordingly, when the pod 22 is mounted on the base assembly 12, the working air exhaust pathway "A" proceeds out of exhaust vents 65 beneath the pod 22, through exhaust inlet slots 75, into the exhaust channel 71 and through the base exhaust vents 73 toward the surface to be cleaned. Hence, warm exhaust air can be directed away from the user towards the cleaning surface. Moreover, by routing the working air exhaust pathway A downwardly through multiple housings towards the surface to be cleaned, the sound generated by the working exhaust air flow can be effectively muffled, thus reducing the noise level of the extractor 10 during operation.

A plurality of ventilation slots 62 in the rear wall of the base 32 are arranged to exhaust motor cooling air from the rear of the pod 22 into surrounding atmosphere. The motor cooling air is drawn along a cooling air exhaust path B that extends from inside the pod 22, through motor cooling inlet holes 83 formed in a top wall of a motor housing 77 that surrounds the motor side (not shown) of the motor/blower assembly 52. A motor cooling conduit 79 is fluidly connected to the side of the motor housing 77 and configured to direct the cooling air from the housing 77 into a cooling air exhaust chamber 81 that is fluidly connected to the ventilation slots 62. The base 32 further comprises a motor inlet conduit 58 that is fluidly connected to the motor cavity 50.

Figure 6:
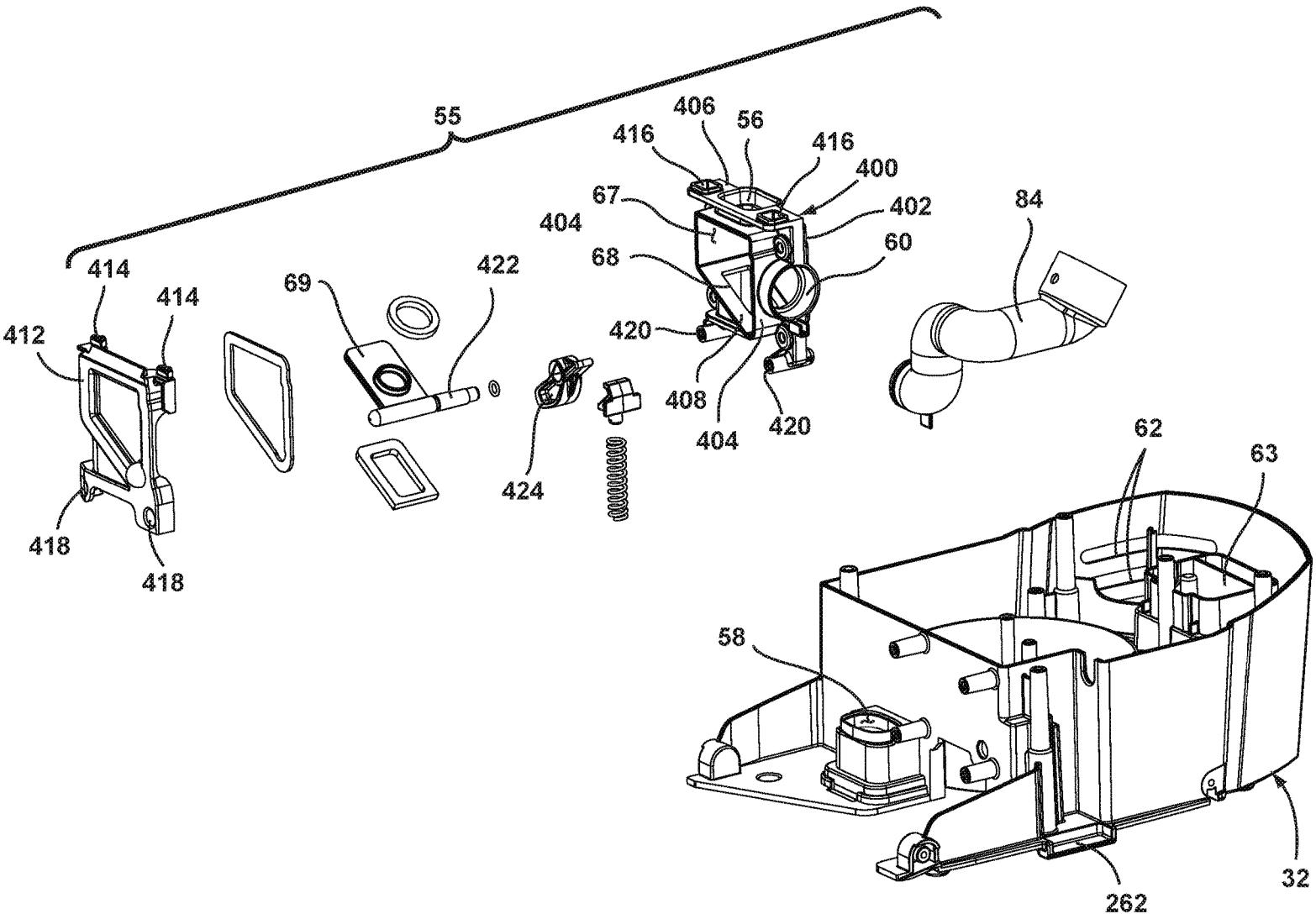
FIG. 6 is an exploded view of a diverter module and a base of the extractor of FIG. 1.

Referring to FIGS. 4-6, a diverter module 55 is mounted to the base 32, adjacent to the motor inlet conduit 58 via conventional fasteners. The diverter module 55 comprises a generally box-shaped diverter housing 400 with an enclosed rear wall 402, opposed sidewalls 404, a top wall 406, and an angled bottom wall, referred to as angled wall 408 that form a diversion chamber 67 therein. A recovery connection, shown herein as a rectangular nozzle inlet 68, is formed within the angled wall 408. Further, a cylindrical hose inlet 60 is formed within one sidewall 404 and a rectangular diverter outlet 56 is formed within the top wall 406. A removable diverter cover 412 is configured to sealingly mate to the open front side of the diverter housing 400. The diverter cover 412 comprises a rectangular plate that is preferably molded out of transparent plastic material to permit visibility of the diversion chamber 67. The diverter cover 412 can be selectively mounted to the diverter housing 400 by any number of known fastening methods such as screws, snaps, and the like, or combinations thereof. As shown in FIG. 6, the diverter cover 412 comprises at least one hook 414 protruding from the top edge that is adapted to selectively engage a corresponding slot 416 in the top wall 406 of the diverter housing 400. The diverter cover 412 further comprises fastener holes 418 along the bottom edge that selectively mate with corresponding mounting bosses 420 on the diverter housing 400.

A diverter door 69 is pivotally mounted within the diversion chamber 67 and adapted to selectively block either of the nozzle inlet 68 or the hose inlet 60. The diverter door 69 comprises an elongate shaft 422 at one end that protrudes through the rear wall 402 of the diverter housing 400. The distal end of the shaft 422 is operably connected to a spring biased actuator arm 424 that is mounted adjacent to the rear wall 402 of the diverter housing 400. A follower and cam are formed, respectively, by the actuator arm 424 in selective registry with a protrusion 426 on the cover plate 152 (FIG. 3). The diverter door 69 is adapted to pivot inside the diversion chamber 67 in response to rotation of the actuator arm 424 to selectively divert working air flowing through either of the nozzle inlet 68 or the hose inlet 60 to the diverter outlet 56. The door 69 is normally spring biased in a downward position such that the door 69 seals against the angled wall 408 within the diversion chamber 67 and blocks the nozzle inlet 68. Alternatively, when the actuator arm 424 is rotated upwardly, the diverter door 69 also pivots upwardly until it seals and blocks the hose inlet 60, which, in turn, opens the nozzle inlet 68.

The diverter module 55 is visible by a user when the recovery tank 110 is removed from the pod 22. Accordingly, a user can look through the transparent diverter cover 412, into the diversion chamber 67 to inspect and ensure that the diverter door 69 is functioning properly and that neither of the diverter nozzle inlet 68, diverter outlet 56, or the hose conduit opening 60 is clogged. If a user notices that the diverter module 55 is malfunctioning, this configuration permits a user to easily remove the diverter cover 412 by unfastening two screws retaining the cover 412 to the housing 400, pivoting the cover 412 upwardly, and then disengaging the hook 414 from the slot 416. Accordingly, a user can clean and clear any debris clogging the diversion chamber 67 or jamming the diverter door 69 in a facile manner.

The base 32 further comprises a tower 63 that protrudes upwardly from the bottom of the base 32. An electrical connection, shown in the form of a male connector 146 (FIG. 17A-C), can be mounted within the tower 63. Additionally, a fluid delivery connector illustrated herein as a spray tip valve 144, a pump 142 for pressurizing the cleaning fluid, a solenoid valve 148, and other common extractor components can be mounted to the base 32 and electrically connected to the male connector 146.

The base cover 34 is a generally rectilinear body incorporating various indentations and attachment features such as bosses, ribs, and the like for attaching the components that are mounted to the base cover 34. The base cover 34 comprises a generally horizontal top wall 38 and a generally vertical front wall 40 that extends upwardly from the top wall 38. The top wall 38 also includes a valve opening 42 therethrough. The base cover 34 is mounted to the base 32 by any suitable attachment means, and together they enclose the components mounted therein.

Additionally, the pod handle 36 is mounted to the base cover 34. The handle 36 is positioned between the recovery and supply tank assemblies 24, 26 and transverse to the extractor 10 and pod 22 for facile lifting and carrying. A main power switch 140 is mounted in the handle 36 and is electrically connected to the motor/blower assembly 52, the pump 142, the solenoid valve 148, a power cord (not shown), and other electrical components of the extractor 10, as will be described hereinafter.

The module housing 30 is a belt-like member that encircles the recovery and supply tank assemblies 24, 26. The module housing 30 comprises a body 70 to which the accessory wand 27 is mounted. The accessory wand 27 comprises an accessory hose 80 and an accessory wand handle 90. A hose clip 88 is affixed to the exterior of the module housing 30 to selectively retain the accessory wand handle 90 to the pod 22. A hose conduit 84 passes through an opening 86 in the body 70 near a hose wrap 72. The hose 80 is fluidly connected to one end of the hose conduit 84, thereby connecting the accessory wand 27 to the fluid recovery system, which is described in greater detail hereinafter.

A hose wrap 72 and a cord wrap 74 are also mounted to the module housing 30. The hose wrap 72 can have a generally circular hub 76 from which a plurality of tabs 78 transversely extend. The accessory hose 80 can be wrapped around the hub 76 and retained by the tabs 78 to carry the hose 80 on the pod 22. Similarly, the cord wrap 74 comprises at least two opposing tabs 82 around which a cord (not shown) can be wrapped to carry the cord on the pod 22. The aforementioned components can be mounted to the module housing 30 by any commonly known and suitable means such as mechanical fasteners, sonic welding, adhesive, or the like.

The supply tank assembly 26 comprises a solution tank 92, which defines a cleaning fluid supply chamber 94 for storing a quantity of cleaning fluid. The solution supply tank assembly 26 further comprises a fill cap 96 and a valve 98 which are fastened to a threaded inlet 100 of the solution tank 92. When the solution supply tank assembly 26 is mounted to the pod 22, the valve 98 is received in a receiver 102 that is positioned within the valve opening 42 in the base cover 34. The solution tank 92 can be filled with cleaning solution via inlet 100, and can be selectively removed from the pod 22 by a carry handle 104.

Figure 7:
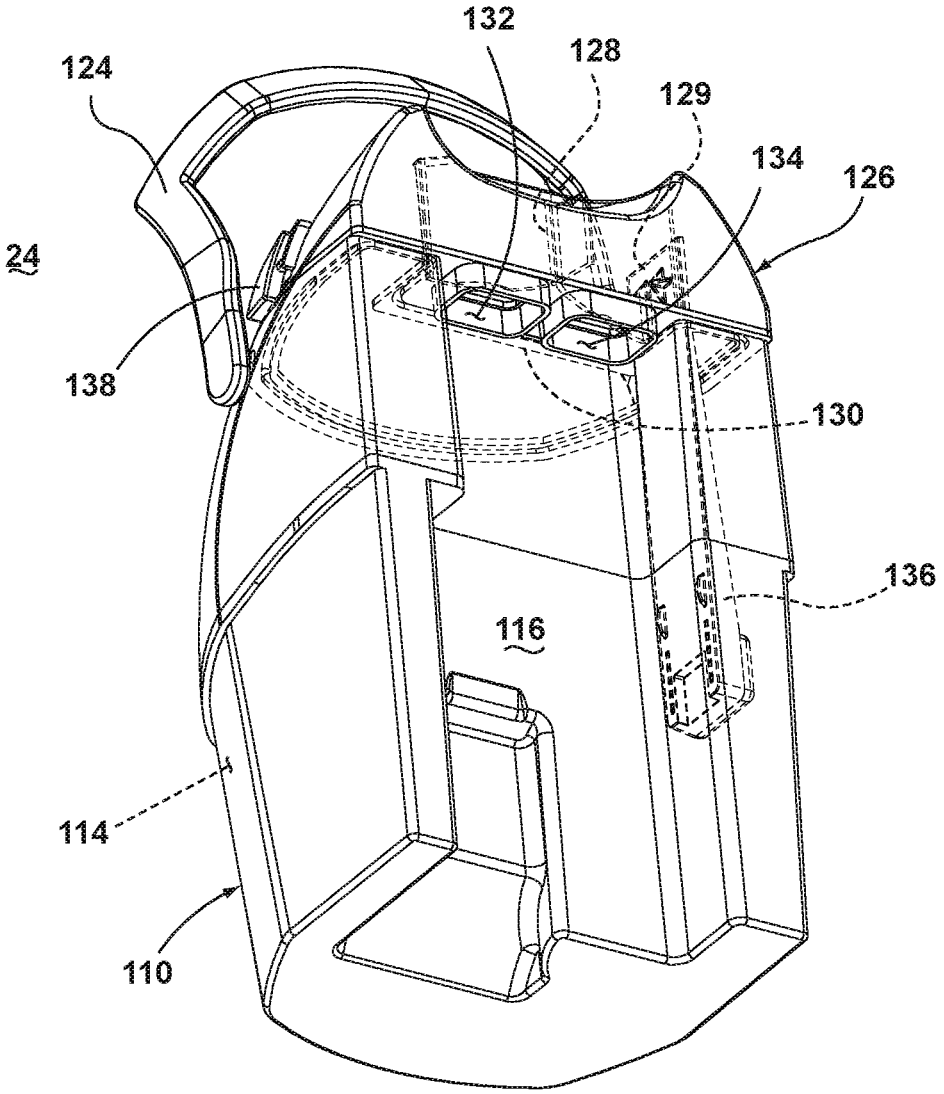
FIG. 7 is a lower perspective view of a recovery tank assembly of the extractor of FIG. 1.

Referring to FIGS. 4 and 7, the recovery tank assembly 24 comprises a recovery tank 110 with an open top which is enclosed by a removable tank cover 126. The recovery tank 110 defines a recovery chamber 114 sized to receive a quantity of spent cleaning solution and dirt. The rear face of the recovery tank 110 includes a recess 116 in which a recovery tank duct assembly 118 is affixed. The recovery tank duct assembly 118 comprises an inlet conduit 120 and an exhaust duct 122. Further, the recovery tank assembly 24 can be selectively removed from the pod 22 by a carry handle 124 in order to discard the spent cleaning fluid and dirt to an appropriate receptacle or waste drain.

The cover 126 comprises a curved divider wall 128 that extends downwardly from the interior of the cover 126. A separator plate 130 is fixed to the lower portion of the cover 126 by any commonly known and suitable means and comprises a recovery tank inlet 132 and a recovery tank exhaust outlet 134. The recovery tank inlet 132 is in fluid communication with the downwardly extending inlet conduit 120 (FIG. 4), and the recovery tank exhaust outlet 134 is in fluid communication with the downwardly extending exhaust duct 122 (FIG. 4). The divider wall 128 and separator plate 130 are adapted to provide fluid separation between the recovery tank inlet 132 and the recovery tank exhaust outlet 134. The recovery tank assembly 24 further comprises a float 136 that is slidingly attached to the separator plate 130. The float 136 extends down into the recovery chamber 114. As the fluid level increases in the recovery chamber 114, the buoyant float 136 rises with the rising fluid. An upper portion of the float blocks an opening 129 in the divider wall 128 that is fluidly connected to the recovery tank exhaust outlet 134, thereby preventing liquid from entering the exhaust air flow path. Additionally, the cover 126 is secured to the recovery tank 110 by a latch 138.

Figure 8:
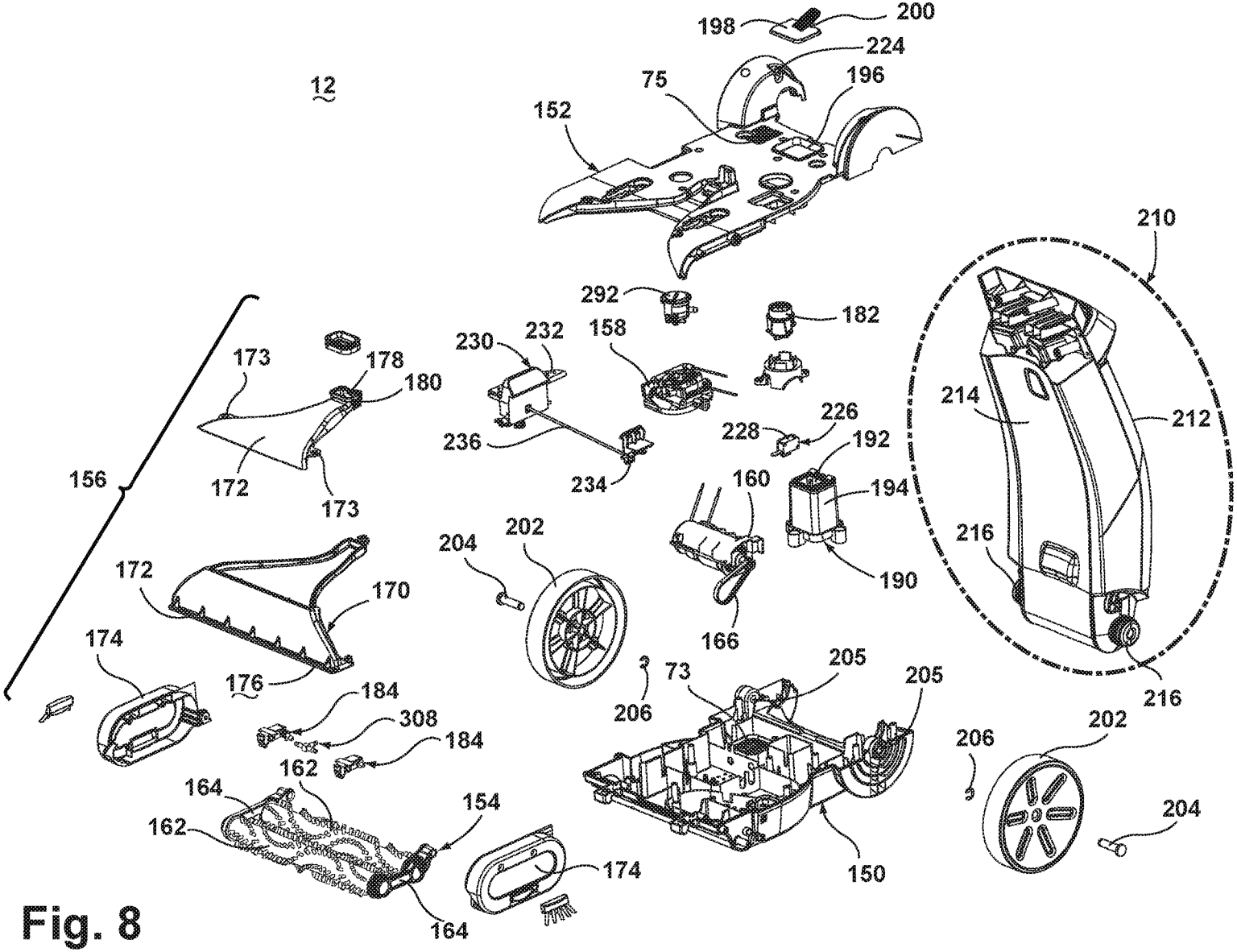
FIG. 8 is an exploded view of the base assembly of the extractor of FIG. 1, also showing a lower handle assembly of the extractor.
Figure 9:
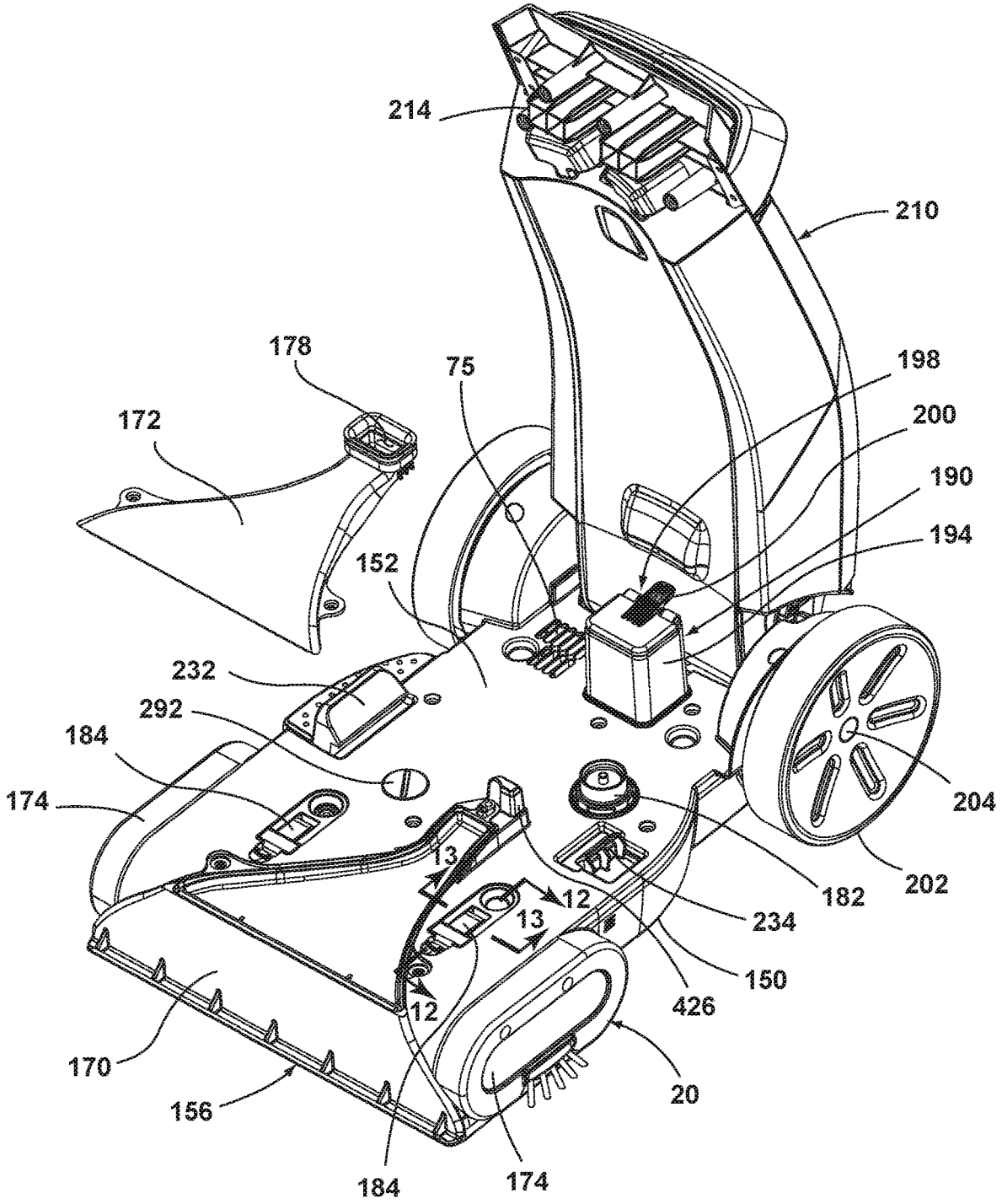
FIG. 9 is a perspective view of the base assembly of the extractor of FIG. 1, with a nozzle cover exploded away.
Figure 10:
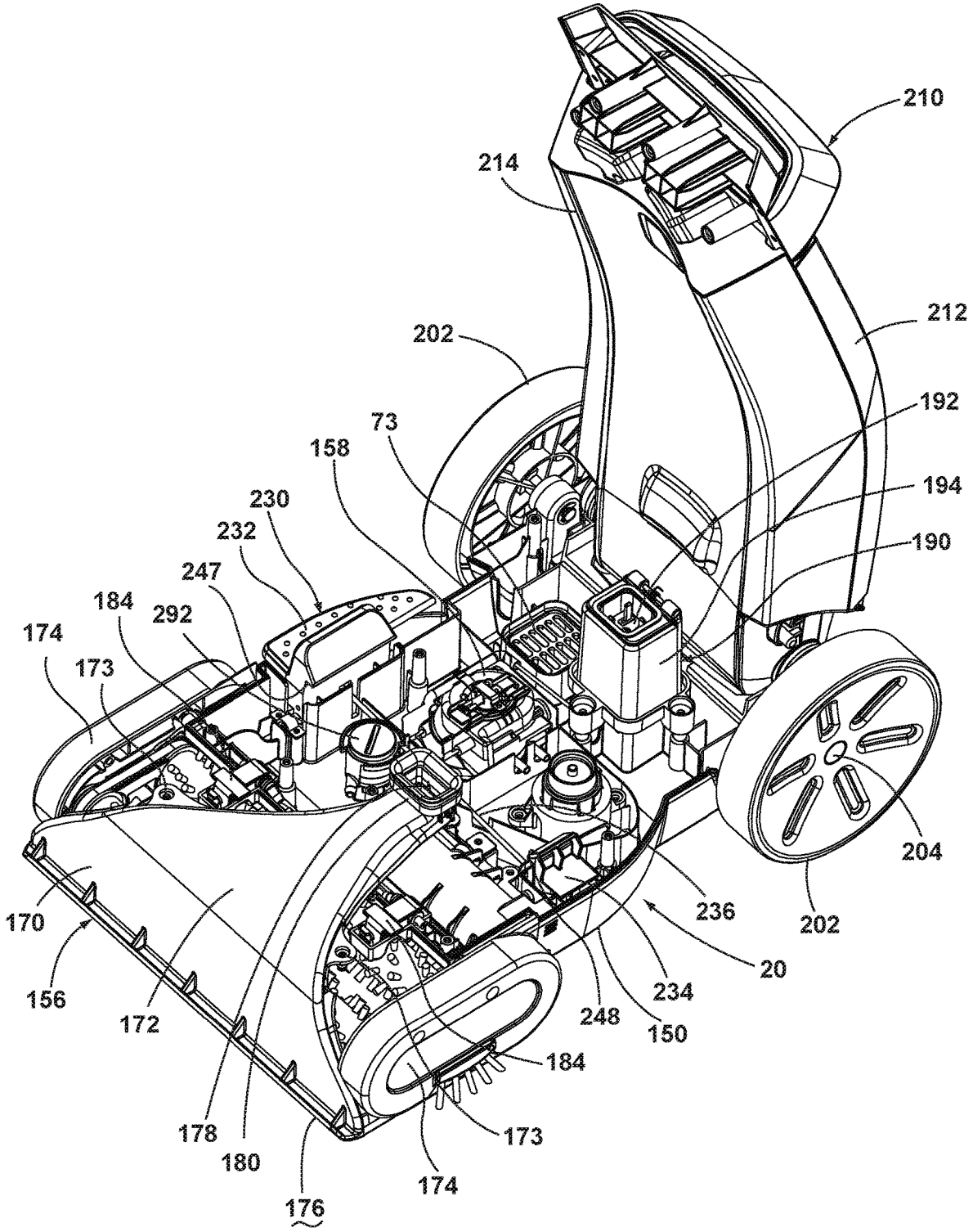
FIG. 10 is a perspective view of the base assembly of the extractor of FIG. 1, with a cover plate removed.

Referring now to FIGS. 8-10, the base platform 20 comprises a base housing 150, a cover plate 152, a brushroll assembly 154, and a floor suction nozzle assembly 156. The base housing 150 is a generally rectilinear body incorporating various internal attachment features such as bosses, ribs, and the like for attaching the components that are mounted inside the base housing 150. The cover plate 152 is mounted to the base housing 150 by any suitable attachment means, and together they enclose the components mounted therein. A heater 158 can be mounted within the base platform 20 for supplying heated cleaning fluid to the fluid distribution system; a brush motor 160 can also be mounted within the base platform 20 for driving the brushroll assembly 154. Additionally, a brush motor switch 226 is mounted to the base housing 150 for selectively controlling power to the brush motor 160, as will be described hereinafter.

The brushroll assembly 154 comprises at least one rotatably mounted brushroll 162, opposed support legs 164, and a drive belt 166. The brushroll assembly 154 shown comprises two brushrolls 162 that are rotatably mounted between the opposed support legs 164. The support legs 164 are pivotally mounted to the base housing 150. The brushrolls 162 comprise geared ends (not shown) such that each brushroll 162 can be operably connected to the brush motor 160 via the drive belt 166 and an intermediate belt (not shown) that operably connects the brushrolls 162, as is well known in the extractor and vacuum cleaner arts. Further, the brushroll assembly 154 is configured to pivot with respect to the base platform 20. This flexible mounting configuration ensures constant engagement between the brushrolls 162 and the cleaning surface, even as the extractor 10 passes over cleaning surfaces having varying heights such as dissimilar carpets, rugs, or the like.

The floor suction nozzle assembly 156 comprises a nozzle body 170, a removable nozzle cover 172, and opposed nozzle end caps 174. The nozzle cover 172 comprises one or more mounting ears 173 that can be secured to the nozzle body 170 by mechanical fasteners (not shown). A gasket (not shown) can be fitted between the nozzle cover 172 and the nozzle body 170 to ensure a sealing connection between the two components. Additional mechanical sealing features such as a lap joint or tongue and groove joint can be incorporated along the mating walls of the nozzle cover 172 and nozzle body 170, either instead of, or in conjunction with the gasket. The nozzle body 170 comprises hooks (not shown) that protrude upwardly from the back wall of the nozzle body 170 that are adapted to engage corresponding retention slots (not shown) formed in the lower forward portion of the end caps 174. Accordingly, the lower forward portion of the nozzle body 170 is retained by the engagement of the hooks and mounting slots, whereas the upper portion of the nozzle body 170 is retained by the nozzle cover 172 and associated mounting ears 173 and fasteners. Accordingly, the mounting configuration permits the nozzle cover 172 to be removed and separated from the nozzle body 170 for facile cleaning of either or both of the nozzle cover 172 and nozzle body 170.

An inlet 176 to the fluid recovery system is defined by an opening in the lower portion of the nozzle body 170. A recovery connection, illustrated herein as an outlet 178 of the nozzle assembly 156 is defined by a flexible nozzle conduit 180 protruding upwardly from the rear of the nozzle cover 172.

The base platform 20 further comprises a fluid delivery connection illustrated herein as a pod receiver 182 and at least one spray tip assembly 184. The pod receiver 182 is mounted to the cover plate 152 and fluidly couples the fluid distribution system to the spray tip assembly 184. The illustrated embodiment comprises two spray tip assemblies 184 that are pivotally mounted to the base housing 150 for dispensing cleaning fluid onto the surface to be cleaned.

Figure 11:
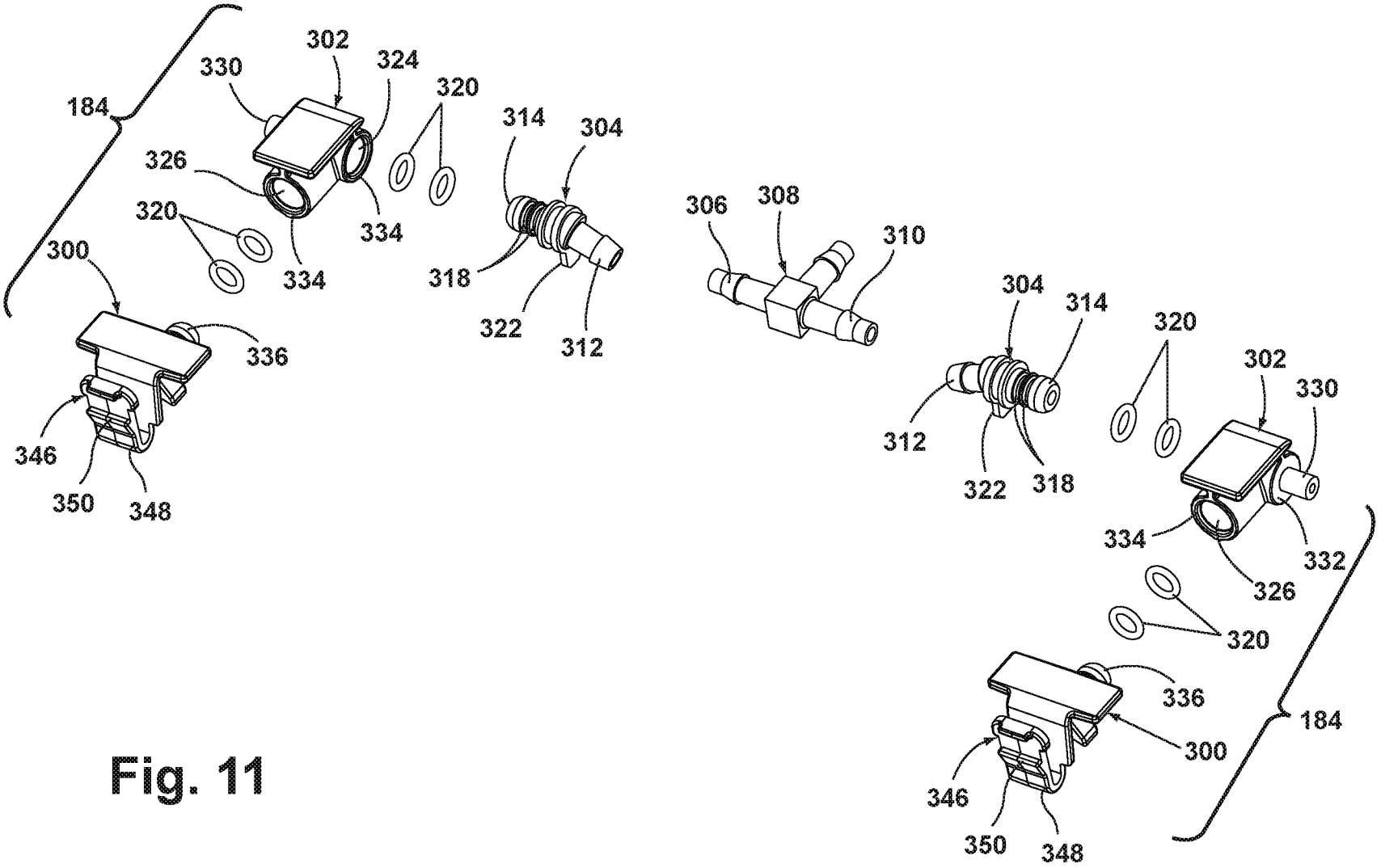
FIG. 11 is an exploded view of a spray tip assembly of the extractor of FIG. 1.
Figure 12:
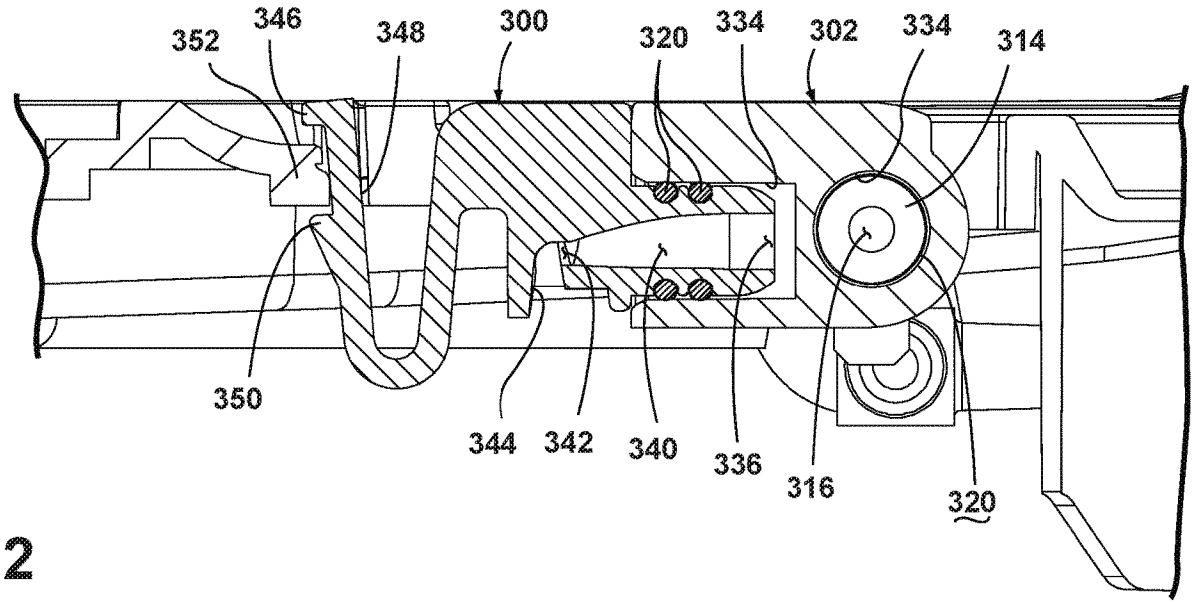
FIG. 12 is a cross-sectional view of the spray tip assembly taken along line 12-12 of FIG. 9.
Figure 13:
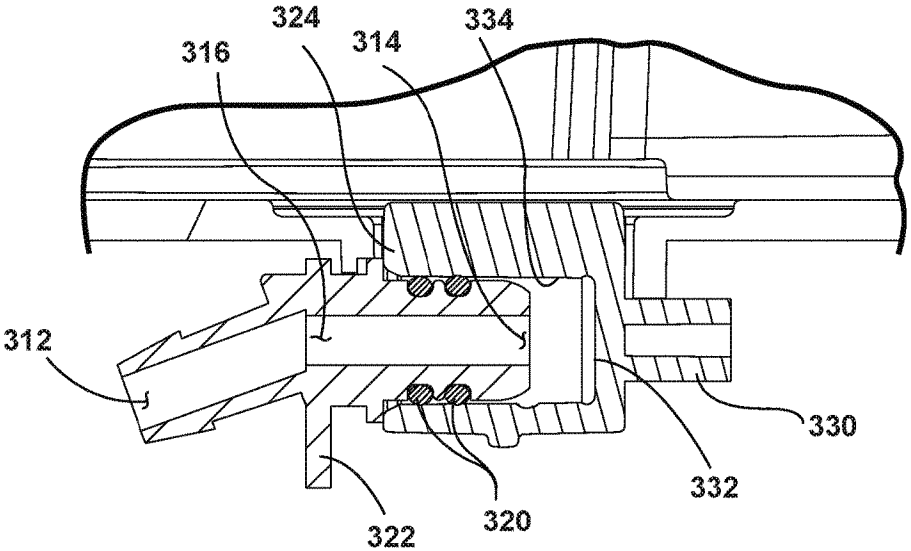
FIG. 13 is a cross-sectional view of the spray tip assembly taken along line 13-13 of FIG. 9.

Referring to FIGS. 11-13, a first spray tip assembly 184 comprises a removable spray tip insert 300 that is fluidly and removably connected to a pivot coupling 302. The pivot coupling 302 is fluidly and rotatably connected to a pivot barb 304. The pivot barb 304 is fluidly connected to a right hand barb 306 that protrudes from a T-fitting 308 via a tubing segment (not shown). A second spray tip assembly 184 is fluidly connected to a left hand barb 310 protruding from the opposite side of the T-fitting 308.

The pivot barb 304 comprises a cylindrical pivot barb inlet 312 and a pivot barb outlet 314 that define an internal liquid flow path 316 oriented along divergent axes that form an obtuse angle. Grooves 318 around the circumference of the outlet 314 are adapted to seat a pair of O-ring seals 320. A mounting leg 322 protrudes downwardly from the junction of the inlet 312 and outlet 314 and is adapted to be received in a corresponding pocket (not shown) in the cover plate 152.

The pivot coupling 302 comprises a cylindrical coupling inlet 324 oriented orthogonal to a cylindrical coupling outlet 326, thus forming an L-shaped liquid flow path 328 therein. A pivot shaft 330 protrudes outwardly from a closed end wall 332 of the coupling inlet 324. The internal sealing surface 334 of the coupling inlet 324 is sized to rotatably and sealingly receive the pivot barb outlet 314 and associated O-ring seals 320. Accordingly, upon installation of the pivot barb outlet 314 into the coupling inlet 324, the O-ring seals 320 compress slightly to create a liquid impermeable seal, while simultaneously permitting rotation of the coupling inlet 324 about the pivot barb outlet 314.

The coupling outlet 326 also comprises a sealing surface 334 that is sized to removably and sealingly receive a spray tip insert inlet 336. The spray tip insert inlet 336 comprises a grooved cylindrical wall 338 adapted to seat two O-ring seals 320 thereon and defining a liquid flow path 340 therein. Upon installation of the spray tip insert inlet 336 into the coupling outlet 326, the O-ring seals 320 seated within the grooved cylindrical wall 338 compress to create a liquid impermeable seal, while also permitting the spray tip insert 300 to be selectively removed for cleaning or replacement.

The spray tip insert 300 further comprises a spray orifice 342 and an associated deflector wall 344 that is spaced from the orifice 342 and adapted to guide pressurized liquid along a desire spray path. The spray tip insert 300 further comprises a resilient latch 346 that is integral to the front portion of the spray tip insert 300. The latch 346 comprises a deflecting leg 348 with a catch 350 arranged to selectively engage a corresponding retainer tab 352 on the cover plate 152.

Referring now to FIGS. 8-10, the base platform 20 further comprises a power assembly 190 through which the base assembly 12 can be electrically connected to the pod 22. The power assembly 190 comprises an electrical connection shown in the form of a female connector 192, an electrical stack 194, a stack collar 196, and a stack cover 198. The female connector 192 is mounted within the electrical stack 194, which protrudes up from the base housing 150 and extends through the stack collar 196 that is formed in the cover plate 152. The electrical stack cover 198 is pivotally mounted to the upper end of the stack collar 196 and is spring (not shown) biased to the horizontal/closed position. Further, a tab 200 protrudes outwardly from the forward facing edge of the stack cover 198.

A pair of wheels 202 is rotatably mounted to the rear of the base platform 20. The wheels 202 are rotatably mounted on axles 204 that are retained within bearing holes 205 on the base housing 150 by retainer clips 206, as is commonly known in the art. The wheels 202 partially support the base assembly 12 on the surface to be cleaned.

A lower handle assembly 210 comprises a rearward shell 212 and a forward shell 214 that mate to form a lower handle cavity therebetween. The lower handle assembly 210 is pivotally mounted to the base platform 20 through a pair of trunnions 216 that are located at a lower portion of the lower handle assembly 210 and are formed in part by each of the rearward and forward shells 212 and 214. A release mechanism 218, best seen in FIG. 2, is mounted within the lower handle assembly 210 to releasably lock the handle assembly 16 to the base assembly 12 in an upright, storage position. The release mechanism 218 comprises a spring biased, pivotally mounted detent pedal 220, as is commonly known in the extractor and vacuum cleaner arts. The release mechanism 218 further comprises a latching rod 222 that extends along the length of the pedal 220, parallel to the pivot axis of the detent pedal 220. The ends of the latching rod 222 selectively engage mounting slots 224 (FIG. 3) formed on opposed sides of the rear portion of the cover plate 152.

A trigger microswitch (not shown) is mounted in the lower handle assembly 210. As will be discussed in more detail hereinafter, the trigger microswitch (not shown) is electrically coupled to the solenoid valve 148 (FIG. 4) and is configured to selectively activate fluid communication between the solution tank 92 and the spray tip assemblies 184 to dispense the cleaning solution onto the surface to be cleaned.

Figure 14:
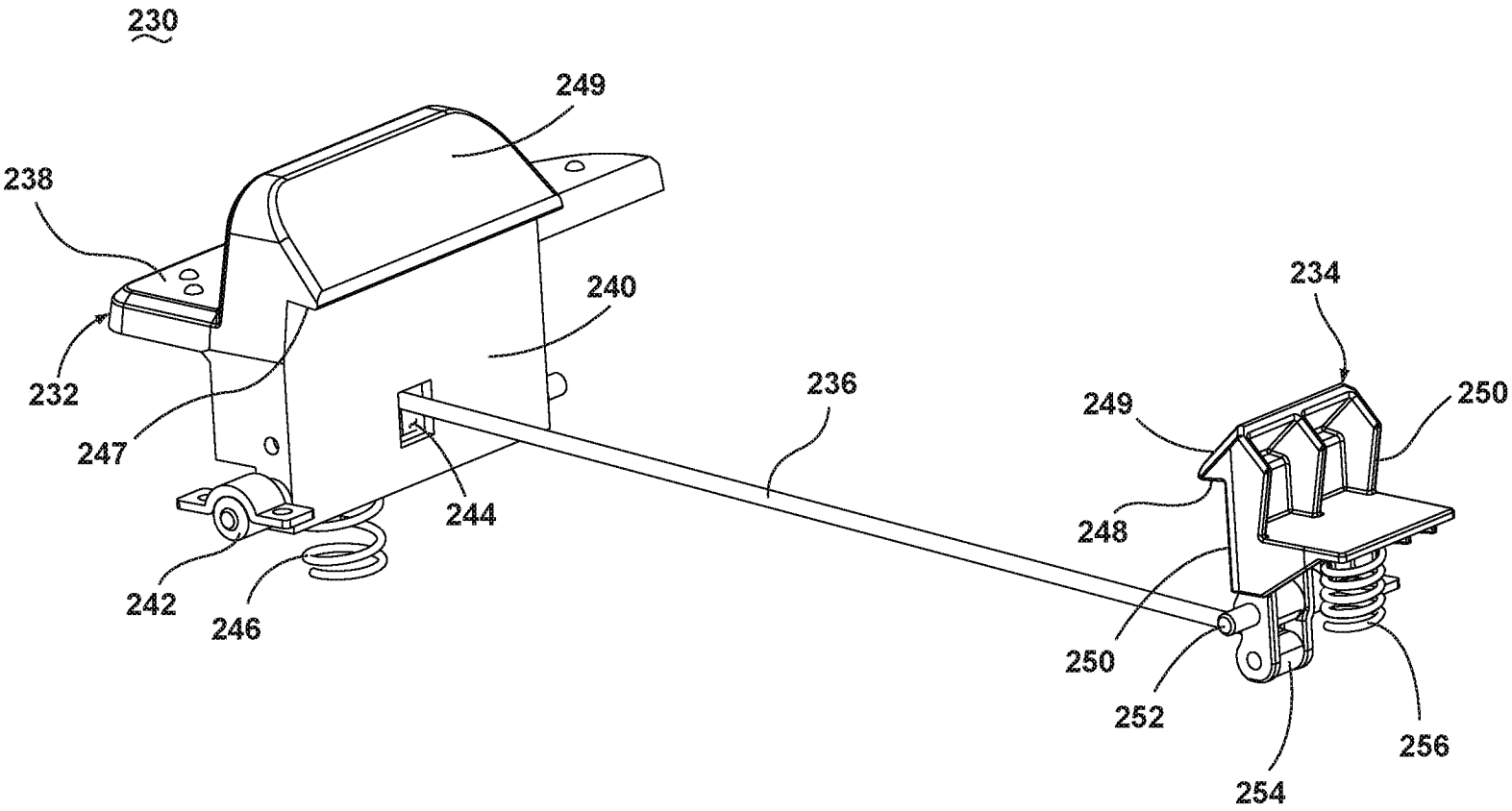
FIG. 14 is a perspective view of a latch assembly of the extractor of FIG. 1.

Referring now to FIGS. 10 and 14, the base platform 20 also includes a latch assembly 230 that releasably retains the pod 22 (FIG. 1) to the base platform 20. The latch assembly 230 comprises a release pedal 232, a latch 234, and a connecting rod 236. The release pedal 232 and the latch 234 are both pivotally mounted to the base housing 150 and are positioned near opposed sidewalls of the base housing 150. Moreover, the release pedal 232 and latch 234 are both spring biased, as is well known in the extractor and vacuum cleaner arts. Further, the release pedal 232 protrudes from the base platform 20 so as to be accessible to the user. The connecting rod 236 is affixed to the release pedal 232 and latch 234 and extends, unobstructed, across the width of the base housing 150.

The release pedal 232 is a generally L-shaped member comprising a foot plate 238 and a pivot leg 240, which are substantially orthogonal to one another. A pedal catch 247 extends across the top portion of the pivot leg 240 and is adapted to selectively engage a detent 262 (FIG. 3) on one side of the pod 22. A downwardly and inwardly angled lead-in 249 extends across the top inner edge of the pedal catch 247. The top surface of the foot plate 238 can comprise a plurality of raised bumps or other features to increase friction between the plate 238 and a user's foot. A pivot shaft 242 is located at a lower portion of the pivot leg 240, spaced from the foot plate 238, and is pivotally retained between the base housing 150 and the cover plate 152 (FIG. 3). The pivot leg 240 also includes a passage 244 through which a pedal end (not shown) of the connecting rod 236 passes. The passage 244 is located above the pivot shaft 242, and therefore above the pivot point of the release pedal 232. Additionally, a torsion spring 246, or any other suitable biasing means, biases the release pedal 232 upward.

The latch 234 is also a generally L-shaped member comprising a catch 248 and a pivot leg 250, which are substantially orthogonal to one another. A downwardly and inwardly angled lead-in 249 extends across the top inner edge of the catch 248. A pivot shaft 252 is located at a lower portion of the pivot leg 250, spaced from the catch 248, and is pivotally retained between the base housing 150 and the cover plate 152 (FIG. 3). The latch 234 also comprises a rod channel 254 for retaining a latch end (not shown) of the connecting rod 236. The rod channel 254 is located below the pivot shaft 252, and therefore below the pivot point of the latch 234. Additionally, a torsion spring 256, or any other suitable biasing means, biases the latch 234 toward the center of the extractor 10.

The connecting rod 236 is an elongated member comprising ends (not shown) which are bent substantially perpendicular to the center portion. The pedal end passes through the passage 244 and lies adjacent the pivot leg 240 above the pivot shaft 242. The latch end is inserted into the rod channel 254 of the latch 234.

Figure 15:
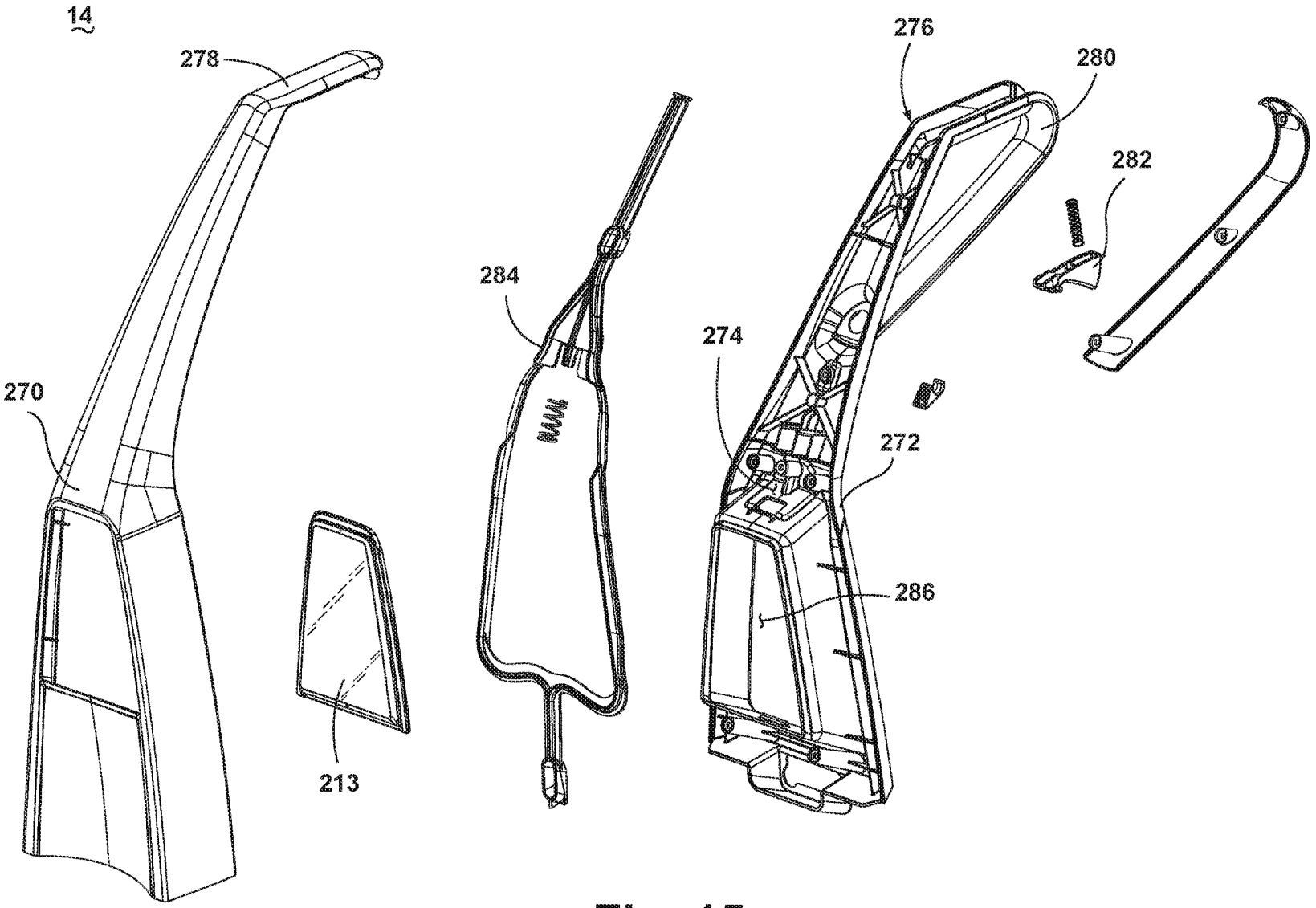
FIG. 15 is an exploded view of the upper handle assembly of the extractor of FIG. 1.

Referring to FIG. 15, the handle assembly 16 comprises a lower handle assembly 210 (FIG. 3) (previously described) and an upper handle assembly 14. The upper handle assembly 14 comprises a forward shell 270 and a rearward shell 272 that mate to form an upper handle cavity 274 therebetween. A handle grip 276 is mounted to the upper portion of the upper handle assembly 14 for maneuvering the extractor 10 across the surface to be cleaned. The handle grip 276 is formed by two mating halves, a forward member 278 and a rearward member 280. The handle grip 276 further comprises a fluid trigger 282 pivotally mounted between the mating members 278, 280 and operatively coupled to a push rod 284 that is enclosed within the upper handle cavity 274. As will be discussed in more detail hereinafter, the push rod 284 is slidingly coupled to the trigger 282 and is configured to selectively activate the trigger microswitch (not shown) located in the top of the lower handle assembly 210 (FIG. 3). The upper handle assembly 14 also includes a recess 286, formed in the shells 270 and 272, in which cleaning accessory tools can be mounted and stored. A transparent window 273 can be secured to the forward shell 270 to enhance visibility of the recess 286. Although not shown, the recess 286 can include mounting clips or other features to enable selected accessory tools or other extractor-related items to be mounted. The upper handle assembly 14 is secured to the lower handle assembly 210 by any suitable mechanical means, such as fasteners, screws, or the like.

Referring back to FIGS. 3 and 14, the above described latch assembly 230 is configured such that the user can selectively remove the pod 22 from the base assembly 12 to use the extractor 10 as a portable cleaning apparatus. To release the pod 22 from the base platform 20, the user depresses the release pedal 232, which pivots the release pedal 232 downwardly against the spring 246 bias. Because the pedal end of the connecting rod 236 is affixed to the release pedal 232 above the pivot axis of the pivot shaft 242 the connecting rod 236 is translated to the right, or outwardly, away from the centerline of the extractor 10. This outward motion pulls the latch end of the connecting rod 236 in the same direction, to the right also. The latch end, however, is affixed to the latch 234 below the pivot axis of the pivot shaft 252, which in turn pivots the catch 248 of the latch 234 to the left, or outwardly, away from the centerline of the extractor 10, thereby releasing the mating detent 262 on the pod 22. The pod 22 is then free to be lifted off the base 12.

Figure 16:
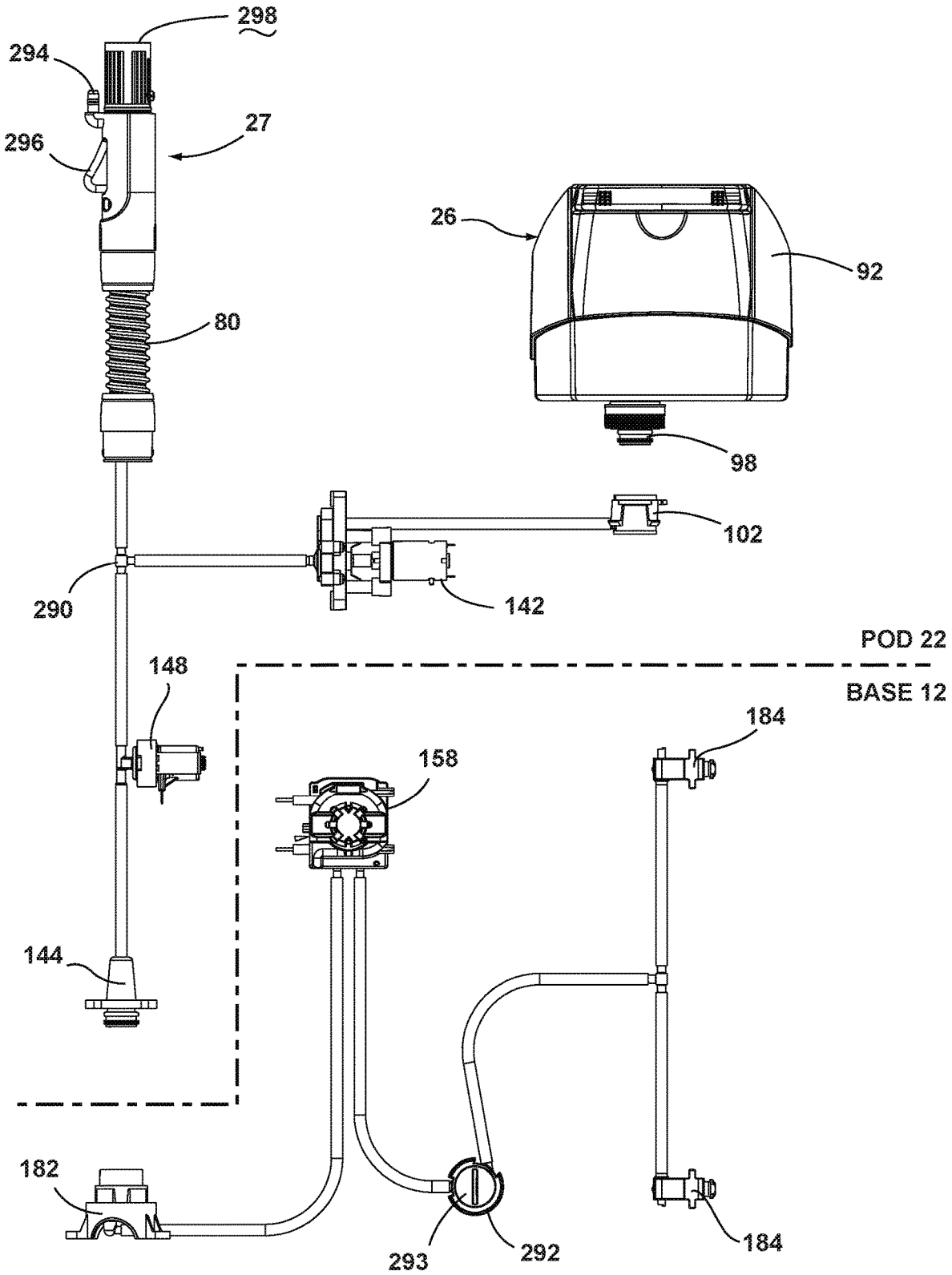
FIG. 16 is a schematic view of a fluid distribution system of the extractor of FIG. 1.

As mentioned above, the extractor 10 comprises a fluid delivery system for storing the cleaning fluid and delivering the cleaning fluid to the surface to be cleaned. For visual clarity, the various electrical connections within the fluid delivery system are not shown in the drawings described above but are depicted schematically in FIG. 16. Referring now to FIG. 16, the fluid delivery system comprises the solution tank 92 for storing a cleaning fluid. The cleaning fluid can comprise one or more of any suitable cleaning fluids, including, but not limited to, water, concentrated detergent, diluted detergent, and the like. Preferably, the cleaning fluid comprises a mixture of water and concentrated detergent. When the solution supply tank assembly 26 is mounted to the pod 22 (FIG. 1), the receiver 102 opens the normally closed valve 98, which dispenses cleaning fluid to the downstream fluid delivery system. An exemplary valve and valve seat are disclosed in U.S. Pat. No. 6,167,586, which is incorporated herein by reference in its entirety. The cleaning fluid flows from the solution tank 92 to the pump 142, which pressurizes the cleaning fluid. It should be noted that the valve 98 is normally closed, such that when the solution tank assembly 26 is removed from the pod 22, cleaning fluid is prevented from flowing out of the solution tank 92.

Pressurized fluid exits the pump 142 and flows into a T-fitting 290 that is fluidly connected to both the accessory wand 27 and the mechanical spray tip valve 144, which is spring biased to a normally closed position. The solenoid valve 148 is positioned in the fluid flow path upstream from the spray tip valve 144 to selectively control the flow of fluid thereto. When the user depresses the fluid trigger 282 (FIG. 15) on the upper handle assembly 14, the push rod 284 slides downwardly and engages the microswitch (not shown), which, in turn, actuates the solenoid valve 148 to permit pressurized cleaning fluid to flow through the solenoid valve 148 to the spray tip valve 144. It should be noted that the spray tip valve 144 is normally closed, such that when the pod 22 is removed from the base assembly 12, cleaning fluid is prevented from flowing out of the spray tip valve 144.

When the pod 22 is mounted to the base assembly 12 with the solenoid valve 148 opened, the receiver 182, which is mounted in the base platform 20, opens the normally closed spray tip valve 144 thereby connecting the fluid delivery connections between the pod 22 and the base assembly 12 and permitting pressurized cleaning fluid to be delivered from the supply tank assembly 26 to the spray tip assemblies 184 for dispensing cleaning fluid onto the surface to be cleaned. Additionally, the heater 158 and a fluid filter 292 can be fluidly connected between the receiver 182 and the spray tip assemblies 184. The heater 158 can be adapted to increase the temperature of the cleaning fluid. An in-line heater for an extraction cleaning machine is disclosed in U.S. Pat. No. 6,131,237, which is incorporated herein by reference in its entirety. The filter 292 can comprise a threaded access cap 293 that can be removed by a user to access and clean a removable mesh screen (not shown) that is adapted to trap small debris and contaminates to prevent clogging the spray tip assemblies 184.

As described above, the accessory wand 27 is fluidly connected to the fluid delivery system by the T-fitting 290. The accessory wand 27 comprises an accessory wand spray tip 294 and an accessory wand fluid trigger 296. The fluid trigger 296 is operably connected to a normally closed plunger valve (not shown) that is mounted within the accessory wand 27 and fluidly connected to the spray tip 294 and the T-fitting 290. The spray tip 294 is operably connected to the plunger valve such that when the user depresses the fluid trigger 296, the plunger valve opens and delivers the pressurized cleaning fluid through the accessory wand spray tip 294, and onto the surface to be cleaned. Optionally, an assortment of interchangeable accessory tools (not shown) can be fluidly connected to the distal end of the accessory wand such that cleaning fluid flows through the spray tip 294, through the accessory tool (not shown) and onto the surface to be cleaned.

The above described fluid delivery system configuration permits fluid to be selectively dispensed through both of the spray tip assemblies 184 located in the base assembly 12 when the pod 22 is mounted to the base assembly 12, or, alternatively, through the accessory hose spray tip 294 located in the accessory wand 27, when the pod 22 is detached from the base assembly 12. A user can selectively control fluid flow to the spray tip assemblies 184 by selectively depressing the fluid trigger 282 located in the handle. Likewise, a user can selectively control fluid flow to the accessory hose spray tip 294 by selectively depressing the accessory wand fluid trigger 296.

As will be recognized by one skilled in the extractor art, the fluid delivery system can include various modifications. Furthermore, the pump 142 is optional and can be eliminated in lieu of a commonly known gravity fed fluid delivery system. Additionally, the spray tip assembly 184 can be replaced by a plurality of spray tips or an alternate fluid distributor, such as a perforated distribution bar.

As mentioned above, the extractor 10 comprises a fluid recovery system for removing the spent cleaning fluid and dirt from the surface to be cleaned and storing the spent cleaning fluid and dirt. The fluid recovery system comprises the motor/blower assembly 52 that generates a working air flow through the working air path of the extractor 10.

Referring to FIGS. 3-7, when the pod 22 is mounted to the base assembly 12 in the floor cleaning mode, a working air path C originates at the nozzle inlet 176 and extends through the fluid flow path in the nozzle assembly 156, through the nozzle conduit 180, and the nozzle outlet 178. The working air path continues into the pod 22 by entering the diversion chamber 67 through the nozzle inlet 68 in the diverter housing 400. The working air path C exits the diversion chamber 67 through the diverter outlet 56, and continues on to the inlet conduit 120, which is in fluid communication with the recovery tank inlet 132. The working air path C passes through the recovery tank inlet 132 into the air/fluid separation chamber where it passes over the separator plate 130. As described above, the divider wall 128 and separator plate 130 provide fluid separation between the recovery tank inlet 132 and the recovery tank exhaust outlet 134. The recovered dirt and water fall into the recovery chamber 114.

The working air path "C" transitions into the working air exhaust pathway "A" when it exits the recovery chamber 114. The working air exhaust pathway "A" exits the recovery chamber 114 through the opening 129 and recovery tank exhaust outlet 134, and into the exhaust duct 122, which is fluidly connected to the motor inlet conduit 58 in the base 32. The working air passes through the motor inlet conduit 58 and enters the motor cavity 50. As previously described, the working air is drawn through the motor/blower assembly 52 and exits the motor cavity 50 through the exhaust holes 54, and passes through a working air exhaust chamber 53 formed between the air path cover 64 and the base 32 and out the exhaust vents 65. The working air continues through to flow through an exhaust channel 71 and out the base exhaust vents 73. Thus air can be exhausted from the bottom of the extractor 10 towards the surface to be cleaned and into surrounding atmosphere.

The previously described fluid recovery system is operable only through the base assembly 12 floor suction nozzle assembly 156 when the pod 22 is mounted to the base assembly 12. To enable suction through the accessory wand 27 and attached hose, the pod 22 must be removed from the base assembly 12 and used in the portable accessory cleaning mode. Removing the pod 22 from the base assembly 12 automatically diverts the working air path through the accessory wand 27.

Referring to FIGS. 3 and 6, removing the pod 22 from the base assembly 12 lifts the nozzle inlet 68 off of the nozzle conduit 180, thereby disconnecting the recovery connections between the pod 22 and base assembly 12, and slides the actuator arm 424 attached to the shaft 422 of the diverter door 69 away from the protrusion 426, which allows the spring-biased diverter door 69 to pivot downwardly to a closed position. Accordingly, when the pod 22 is removed from the base assembly 12, the door 69 blocks off the nozzle inlet 68 in the diverter housing 400 and the working air path therethrough. Moreover, blocking off the nozzle inlet 68 opens a working air path between the hose inlet 60 and the diverter outlet 56, recovery tank duct assembly 118 and upstream accessory wand 27. The working air path originates at an accessory wand nozzle inlet 298 on the accessory wand handle 90, and continues through the accessory hose 80. The accessory hose 80 is fluidly connected to the hose conduit 84, which in turn, is fluidly connected to the hose inlet 60 and diversion chamber 67. From the diversion chamber 67, the working air then flows through the remainder of the working air path, including the recovery tank 24, motor inlet conduit 58, motor cavity 50, a suction source comprising a motor/blower assembly 52, and downstream exhaust holes 54 and ventilation slots 62 as previously described for the floor cleaning mode. Conversely, when the pod 22 is mounted on the base assembly 12, the actuator arm 424 contacts the protrusion 426, which pivots the diverter door 69 upwardly, thus opening the diverter outlet 56 and blocking the hose inlet 60. Accordingly, when the pod 22 is mounted to the base assembly 12, the working air path C flows through the floor suction nozzle assembly 156 and downstream fluid recovery system while the working air flow path through the accessory wand 27 is simultaneously blocked.

Figure 17A:
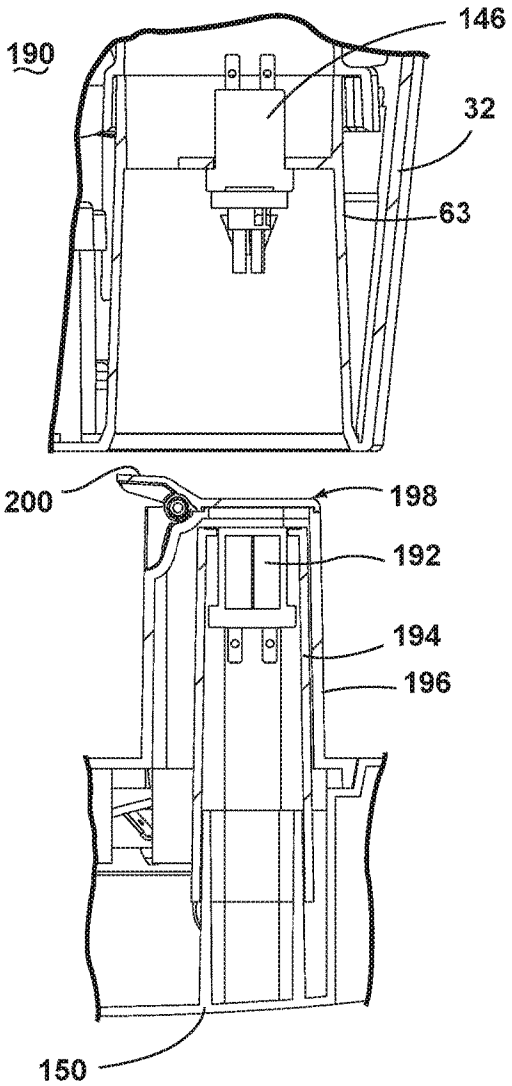
FIG. 17A is a cross-sectional view of a power assembly of the extractor of FIG. 1, illustrating a position when the pod is removed from the base assembly.
Figure 17B:
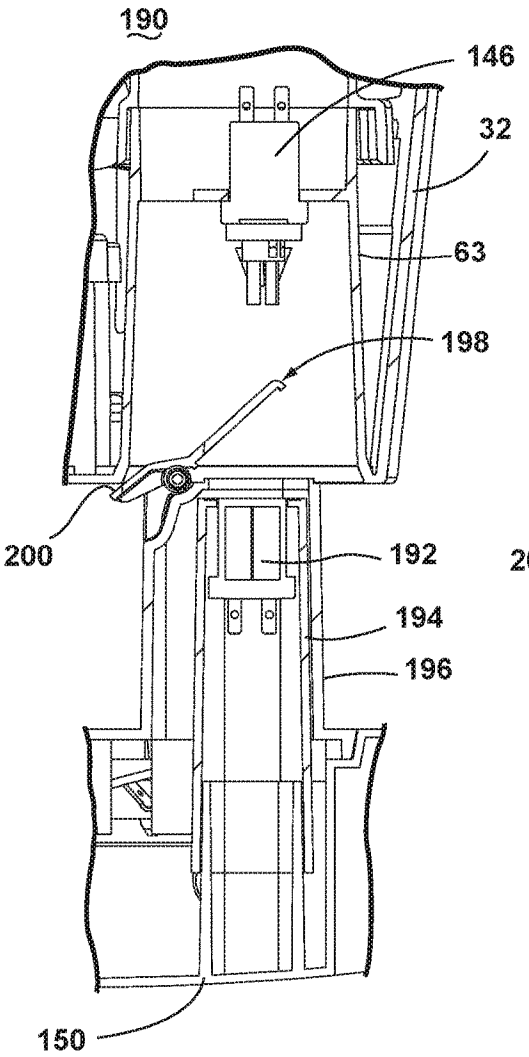
FIG. 17B is a cross-sectional view of a power assembly of the extractor of FIG. 1, illustrating a position when the pod is partially seated on the base assembly.
Figure 17C:
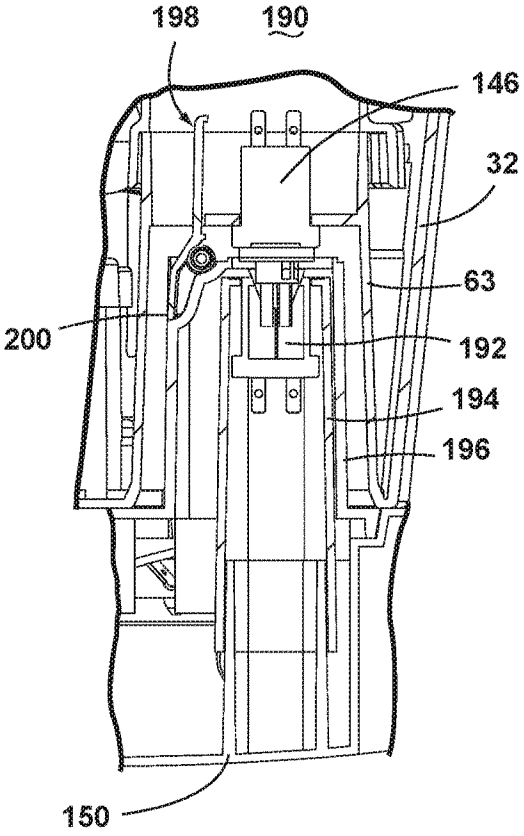
FIG. 17C is a cross-sectional view of a power assembly of the extractor of FIG. 1, illustrating a position when the pod is seated on the base assembly.

Referring now to FIGS. 17A-C, the power assembly 190 is configured to selectively provide power from the pod 22 to the base assembly 12. When the pod 22 is removed from the base assembly 12, the male connector 146 mounted in the tower 63 of the base 32 of the pod 22 is lifted away and disconnected from the mating female connector 192 mounted in the base assembly 12, thereby disconnecting the electrical connections between the pod 22 and base assembly 12. As shown in FIG. 17A, the stack cover 198 is spring biased to a horizontal/closed position in which the stack cover 198 encloses the open upper end of the electrical stack 194, thereby covering and protecting the electrical connector 192 housed therein.

As the pod 22 is installed onto the base assembly 12, the lower portion of the tower 63 contacts the tab 200 of the stack cover 198 and pivots the stack cover 198 upwardly against its spring bias to a partially open position, as seen in FIG. 17B. As the pod 22 continues to be lowered into the installed position, the tower 63 pivots the stack cover 198 to a fully open position, thereby exposing the female connector 192. Referring now to FIG. 17C, when the pod 22 is fully seated onto the base assembly 12, the male and female connectors 146, 192 fully engage and make an electrical connection between the pod 22 and the base assembly 12.

This configuration protects the male and female connectors 146 and 192. When the pod 22 is removed from the base assembly 12, the male connector 146, located on the underside of the pod 22, is protected because it is recessed within the tower 63. Further, the female connector 192 is protected by the stack cover 198, which shields the connector 192 from liquid, debris, and user contact, for example.

A description of the operation of the extractor 10 follows. It will be appreciated by one of ordinary skill in the extractor art that the operation can proceed in any logical order and is not limited to the sequence described below. The following description is for illustrative purposes only and is not intended to limit the scope of the invention in any manner.

Prior to operation, the pod 22 can be operably mounted to the base assembly 12, or can be detached from the base assembly 12 to be used as a standalone extractor. As the pod 22 is mounted to the base assembly 12, several connections between components systems can be made contemporaneously. In the illustrated embodiment, four such connections are made, although the extractor 10 can also be configured such that fewer connections are made at the same time. While the four illustrated connections will be described in more detail below, they are, generally: the interconnection of the fluid delivery system, the interconnection of the recovery connections, the interconnection of the exhaust system, and the interconnection of the electrical system. More specifically, the spray tip valve 144 is adapted to be connected with the pod receiver 182 when the pod 22 is operably mounted to the base assembly 12, such that cleaning fluid can be dispensed to the floor surface, the outlet 178, which is fluidly interconnected with the suction nozzle assembly 156, is adapted to be connected with the nozzle inlet 68 when the pod 22 is operably mounted to the base assembly 12, such that the motor/blower assembly 52 is fluidly interconnected to the suction nozzle assembly 156, the exhaust inlet slots 75, which is fluidly interconnected with the exhaust vent 73, is adapted to be connected with the exhaust vents 65 when the pod 22 is operably mounted to the base assembly 12, such that the outlet of the motor/blower assembly 52 is fluidly interconnected to the exhaust vent 73, and the female connector 192 is adapted to be connected with the male connector 146 when the pod 22 is operably mounted to the base assembly 12.

In operation, a user prepares the extractor 10 for use by filling the solution tank 92 with at least one cleaning fluid. To fill the solution tank 92 with cleaning fluid, the user removes the solution supply tank assembly 26 from the pod 22 by simply lifting the solution supply tank assembly 26 by the carry handle 104, which disengages the valve 98 from the receiver 102. Next, the user unscrews and removes the fill cap 96 from the inlet 100 and fills the solution tank 92 with cleaning fluid. The user then replaces the fill cap 96 onto the inlet 100 and mounts the solution supply tank assembly 26 onto the pod 22, thereby coupling the valve 98 with the receiver 102, which opens the valve 98 and fluidly connects the solution tank 92 with the fluid distribution system.

Figure 18:
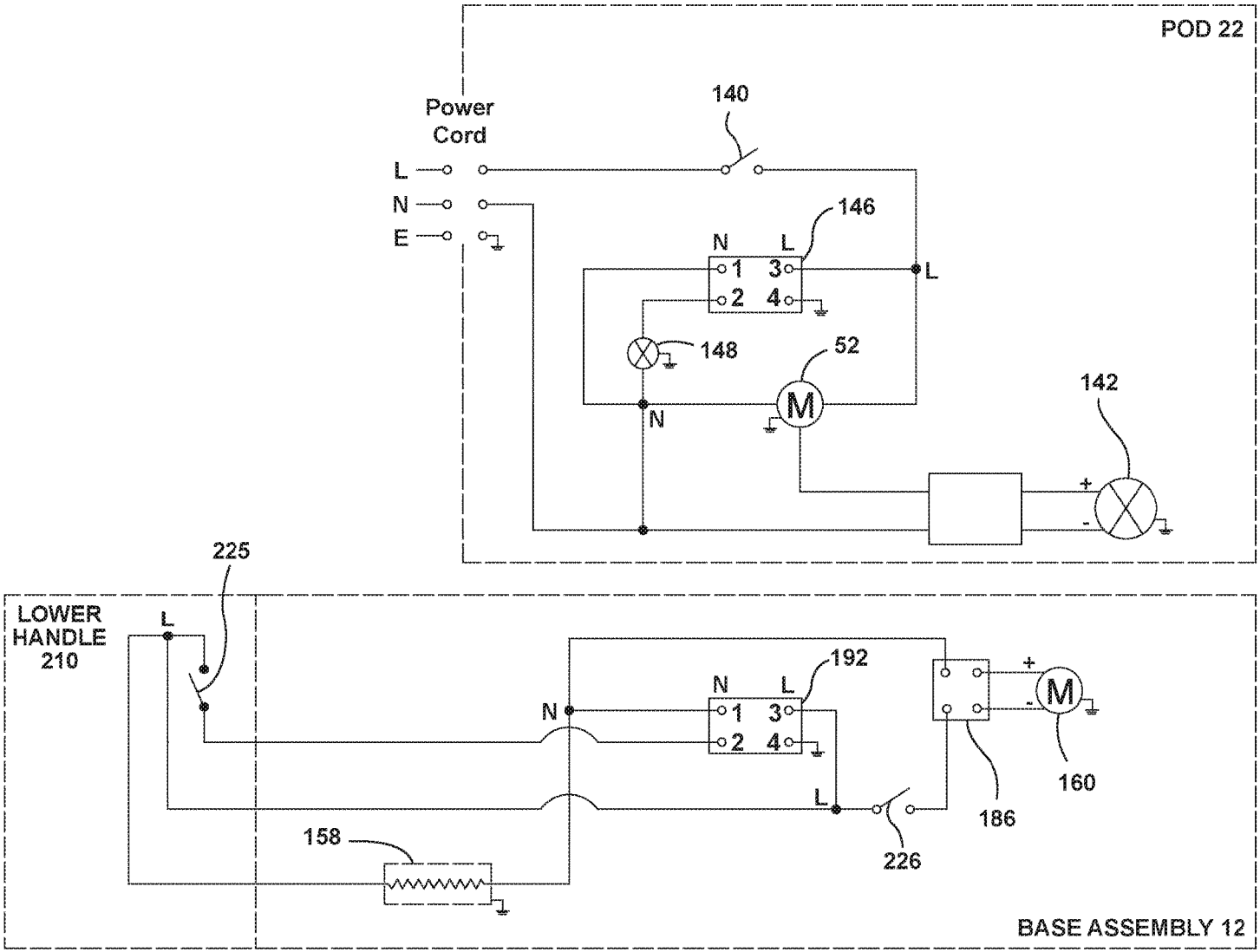
FIG. 18 is a schematic view of an electrical system of the extractor of FIG. 1.

To operate the deep cleaner 10 in the floor cleaning mode, with the pod 22 mounted to the base assembly 12, the user actuates the main power switch 140 to supply power from a power source, such as an electrical outlet, to energize the motor/blower assembly 52 which generates a working airflow through the fluid recovery system. Additionally, the main power switch 140 simultaneously energizes the pump 142, and the solenoid valve 148, as shown schematically in FIG. 18. Power is supplied to the base assembly 12 through the pod 22 when the pod 22 is mounted thereon. The base assembly 12 and pod 22 are electrically connected through the mating male and female electrical connectors 146, 192 as described above.

Power supplied from the pod 22 can energize the electrical components within the base assembly comprising the heater 158, the brush motor 160, and a PCB 186. Power to the brush motor 160 is selectively controlled by the brush motor switch 226 mounted within the base assembly 12. The normally open brush motor switch 226 is configured to close and supply power to the brush motor 160 when the handle assembly 16 is reclined during use. To recline the handle assembly 16, the user depresses the detent pedal 220, which disengages the release mechanism 218 from the base housing 150 and frees the handle assembly 15 to pivot rearwardly. When the user reclines the handle assembly 16, a protrusion (not shown) on the right hand trunnion 216 of the lower handle assembly 210 releases an actuator button 228 (FIG. 8) on the brush motor switch 226, which closes the brush motor switch 226 and supplies power to the brush motor 160 for floor cleaning. When the handle assembly 16 is returned to the upright storage position, the protrusion (no shown) on the trunnion 216 engages the actuator button 228, which opens the brush motor switch 226 and cuts power to the brush motor 160.

With the handle assembly 16 reclined and brush motor 160 energized, the user grasps the handle grip 276 and moves the extractor 10 along the surface to be cleaned while selectively applying the cleaning fluid by depressing the fluid trigger 282. The cleaning fluid is dispensed through spray tip assemblies 184 while the brushrolls 162 agitate the surface to be cleaned. The user may also selectively dispense cleaning fluid through the accessory wand spray tip 294 by depressing the accessory wand fluid trigger 296. Spent cleaning fluid and dirt on the surface to be cleaned are entrained in the working air flow and removed through the floor suction nozzle assembly 156 and flow through the working air path C described above, into the recovery chamber 114, where the spent cleaning fluid and dirt are separated from the working air. The working air continues along the working air exhaust pathway A out of the recovery chamber 114 to the motor cavity 50, and the exhaust air from the motor cavity 50 proceeds out of exhaust vents 65 beneath the pod, through exhaust inlet slots 75 in the cover plate 152, into the exhaust channel 71 and through the base exhaust vents 73 formed in the bottom of the base housing 150 towards the surface to be cleaned.

The recovery tank assembly 24 is quickly and easily emptied by first grasping the carry handle 124 and lifting the recovery tank assembly 24 off of the module lower body 28. Next, the cover 126 is unlocked and removed from the tank housing 40 by unlatching the latch 138. The user then grasps the recovery tank 110 and inverts it to discard the spent cleaning fluid and dirt to an appropriate receptacle or waste drain.

Moreover, a user may easily clean or replace the spray tip insert 300 by depressing the resilient latch 346 to release the catch 350 from the retainer tab 352. Next, a user lifts the deflecting leg 348 upwardly, which rotates the associated pivot coupling 302 about the pivot barb outlet 314. When the deflecting leg 348 clears the retainer tab 352, a user can pull the spray tip insert 300 out of the pivot coupling 302. The O-ring seals 320 around the spray tip insert inlet 336 slide along the sealing surface 334 inside the coupling outlet 326. Upon removal, a user can easily clear potential clogs from the spray orifice 342 of the spray tip insert 300, or simply replace the entire spray tip insert 300 with a new one and then re-install and remount the spray tip insert 300 following the above-described steps in reverse order.

To operate the extractor 10 in the portable accessory cleaning mode, the user removes the pod 22 from the base assembly 12 by depressing the release pedal 232. As the release pedal 232 pivots downwardly about the pivot shaft 242, the pedal catch 247 pivots outwardly and disengages a corresponding detent (not shown) on the base 32 of the pod 22. The pivot leg 240 pulls the pedal end of the connecting rod 236 outwardly, away from the centerline of the extractor 10, while simultaneously pulling the latch end of the connecting rod 236 inwardly, toward the centerline of the extractor 10. The latch end pulls the rod channel 254 inwardly and because the rod channel 254 is positioned below the pivot shaft 252, the pivot leg 250 and catch 248 pivot outwardly, away from the centerline of the extractor 10, thus disengaging a detent 262 on the base 32 of the pod 22 so that pod 22 can be lifted off of the base 12.

As the user lifts the pod 22 away from the base 12, the actuator arm 424 slides off of the corresponding protrusion 426 on the cover plate 152 and the spring-biased diverter door 69 pivots downwardly and blocks the nozzle inlet 68, while simultaneously opening the working air path to the hose 80 and upstream accessory wand 27 through the hose inlet 60. Additionally, the male connector 146 is separated from the female connector 192, thereby disconnecting power to the electrical circuit in the base assembly 12. The tower 63 disengages the tab 200 of the stack cover 198, which springs back to its spring-biased horizontal/closed position covering the upper end of the electrical stack 194 to shield the electrical connector 192 housed therein from water or debris.

Next, the user actuates the main power switch 140. When desired, the user selectively depresses the accessory wand fluid trigger 296 to dispense cleaning fluid from the solution tank 92, through tubing that fluidly connects the pump 142 and T-fitting 290, and through the accessory wand spray tip 294 and associated accessory tool (not shown) to the surface to be cleaned. The spent cleaning fluid and dirt on the surface to be cleaned are extracted through the accessory tool (not shown), accessory wand nozzle inlet 298 on the accessory wand handle 90, and into the accessory hose 80. As described above, the accessory hose 80 is fluidly connected to the hose conduit 84, the hose inlet 60, and the diversion chamber 67. From the diversion chamber 67, the working air then flows through the remainder of the working air path described above and into the recovery chamber 114, where the spent cleaning fluid and dirt are separated from the working air and the separated working air continues to flow along the working air path out of the recovery chamber 114 to the motor cavity 50, through the motor/blower assembly 52, and the exhaust air from the motor cavity 50 exits the base assembly 12 through exhaust holes 54 and corresponding exhaust vents 65 underneath the base the base 32.

The disclosed embodiments are representative of preferred forms of the invention and are intended to be illustrative rather than definitive of the invention. The illustrated upright extractor is but one example of the variety of deep cleaners with which this invention or some slight variant can be used. Reasonable variation and modification are possible within the forgoing disclosure and drawings without departing from the scope of the invention which is defined by the appended claims.

What is claimed is:

1. An extraction cleaner, comprising:

a portable extractor comprising:

a housing having a suction source;

a suction hose interconnected to the suction source for manually suctioning fluid from a floor surface;

a recovery tank interconnected to the suction hose for receiving recovered fluid from the floor surface;

a fluid delivery system for dispensing a cleaning fluid onto the floor surface; and a first recovery connection fluidly interconnected with the recovery tank; and a base adapted to be moved to perform a cleaning operation on the floor surface when the portable extractor is operably mounted to the base, and the base comprising:

a suction nozzle juxtaposed with the floor surface;

a second recovery connection fluidly interconnected with the suction nozzle and adapted to be connected with the first recovery connection when the portable extractor is operably mounted to the base, such that the suction source is fluidly interconnected to the suction nozzle by the interconnection of the first and second recovery connections; and a diverter valve for selectively fluidly interconnecting the recovery tank with one of the suction hose and the suction nozzle, the diverter valve, comprising:

a follower provided on one of the portable extractor and the base; and a cam provided on the other of the portable extractor and the base wherein the cam is configured to be abutted with the follower upon interconnection of the first and second recovery connections, such that the diverter valve opens fluid communication between the recovery tank and the suction nozzle when the portable extractor is operably mounted to the base.

2. The extraction cleaner of claim 1 wherein the diverter valve further comprises:

a first inlet aligned with the first recovery connection;

a second inlet aligned with the suction hose on the portable extractor; and an outlet fluidly interconnected with the recovery tank on the portable extractor;

wherein the diverter valve is configured to open fluid communication between the first inlet and the outlet and close fluid communication between the second inlet and the outlet when the portable extractor is operably mounted to the base, and is further configured to close fluid communication between the first inlet and the outlet and open fluid communication between the second inlet and the outlet when the portable extractor is detached from the base.

3. The extraction cleaner of claim 2 wherein the diverter valve comprises a door configured to close the first inlet when the portable extractor is detached from the base, and configured to close the second inlet when the portable extractor is operably mounted to the base.

4. The extraction cleaner of claim 3 wherein the follower is provided on the door.

5. The extraction cleaner of claim 3, further comprising a spring associated with the door, wherein the spring biases the door toward the first inlet.

6. The extraction cleaner of claim 1 wherein the base comprises a base platform that supports the portable extractor at a forward portion thereof relative to handle.

7. The extraction cleaner of claim 1 wherein the housing comprises a lower body in which the recovery tank is removably received.

8. The extraction cleaner of claim 7 wherein the lower body encircles the recovery tank and a supply tank.

9. The extraction cleaner of claim 8, further comprising a carry handle including a handle grip extending above the recovery tank and the supply tank.

10. The extraction cleaner of claim 9 wherein the recovery tank comprises a second carry handle and the supply tank comprises a third carry handle.

11. The extraction cleaner of claim 8 wherein the supply tank is provided on the housing rearward of the recovery tank.

12. The extraction cleaner of claim 1 wherein the portable extractor further comprises an accessory hose for manually suctioning fluid from a surface to be cleaned.

13. The extraction cleaner of claim 1, further comprising a latch provided on one of the portable extractor and the base and a cooperating member on the other of the portable extractor and the base for retaining the portable extractor to the base, wherein the latch is movable with respect to the cooperating member between a first position wherein the latch retains the portable extractor to the base, and a second position wherein the portable extractor can be removed from the base.

14. An extraction cleaner, comprising:

a portable extractor comprising:

a housing having a suction source;

a suction hose interconnected to the suction source for manually suctioning fluid from a floor surface;

a recovery tank interconnected to the suction hose for receiving recovered fluid from the floor surface;

a fluid delivery system for dispensing a cleaning fluid onto the floor surface; and a base adapted to be moved to perform a cleaning operation on the floor surface when the portable extractor is operably mounted to the base, the base including a suction nozzle juxtaposed with the floor surface; and a diverter valve for selectively fluidly interconnecting the recovery tank with one of the suction hose and the suction nozzle, the diverter valve, comprising:

a follower provided on one of the portable extractor and the base; and a cam provided on the other of the portable extractor and the base;

wherein the diverter valve opens fluid communication between the recovery tank and the suction nozzle when the portable extractor is operably mounted to the base.

15. The extraction cleaner of claim 14 wherein the base comprises a base platform that supports the portable extractor at a forward portion thereof relative to a handle.

16. The extraction cleaner of claim 14 wherein the housing comprises a lower body in which the recovery tank is removably received.

17. The extraction cleaner of claim 16 wherein the diverter valve further comprises:

a first inlet aligned with a first recovery connection fluidly interconnected with the recovery tank;

a second inlet aligned with the suction hose on the portable extractor; and an outlet fluidly interconnected with the recovery tank on the portable extractor;

wherein the diverter valve is configured to open fluid communication between the first inlet and the outlet and close fluid communication between the second inlet and the outlet when the portable extractor is operably mounted to the base and is further configured to close fluid communication between the first inlet and the outlet and open fluid communication between the second inlet and the outlet when the portable extractor is detached from the base.

18. The extraction cleaner of claim 17 wherein the diverter valve comprises a door configured to close the first inlet when the portable extractor is detached from the base, and configured to close the second inlet when the portable extractor is operably mounted to the base.

19. The extraction cleaner of claim 18 wherein the follower is provided on the door.

20. The extraction cleaner of claim 19, further comprising a spring associated with the door, wherein the spring biases the door toward the first inlet.

* * * * *